US012302975B1

(12) United States Patent
Jurga, Jr. et al.

(10) Patent No.: US 12,302,975 B1
(45) Date of Patent: May 20, 2025

(54) PROTECTIVE HEADGEAR

(71) Applicant: Ampac Enterprises Inc., Shirley, MA (US)

(72) Inventors: Stanley Jurga, Jr., Shirley, MA (US); Austin Rodrick, Ashburnham, MA (US); Shyan Wei Chen, New Taipei (TW)

(73) Assignee: Ampac Enterprises Inc., Shirley, MA (US)

( * ) Notice: Subject to any disclaimer, the term of this patent is extended or adjusted under 35 U.S.C. 154(b) by 76 days.

(21) Appl. No.: 18/105,455

(22) Filed: Feb. 3, 2023

(51) Int. Cl.
*A42B 3/06* (2006.01)
*A42B 3/12* (2006.01)
*A42B 3/20* (2006.01)

(52) U.S. Cl.
CPC ..... *A42B 3/06* (2013.01); *A42B 3/12* (2013.01); *A42B 3/125* (2013.01); *A42B 3/127* (2013.01); *A42B 3/128* (2013.01); *A42B 3/20* (2013.01)

(58) Field of Classification Search
USPC ..... 2/411, 414
See application file for complete search history.

(56) References Cited

U.S. PATENT DOCUMENTS 2,867,813 A * 1/1959 Miller ..... A42B 3/10 2/6.1
3,994,021 A * 11/1976 Villari ..... A42B 3/125 2/413
3,994,022 A * 11/1976 Villari ..... A42B 3/121 2/909
4,947,490 A * 8/1990 Hayden ..... A42B 3/20 2/9
5,271,103 A * 12/1993 Darnell ..... A42B 3/125 2/418
5,477,565 A * 12/1995 Hunt, Jr. ..... A42B 3/20 2/424
5,655,227 A * 8/1997 Sundberg ..... A42C 2/007 2/425
D412,376 S 7/1999 Jurga et al.
5,953,761 A * 9/1999 Jurga ..... A42B 3/145 2/420
7,886,370 B2 * 2/2011 Winningham ..... A63B 71/10 2/9
10,136,692 B2 * 11/2018 Ide ..... A42B 3/125
10,178,889 B2 * 1/2019 Wacter ..... A42B 3/32
2004/0025231 A1 * 2/2004 Ide ..... A42B 3/20 2/424
2012/0017358 A1 * 1/2012 Princip ..... A42B 3/063 2/414

(Continued)

*Primary Examiner* — Jocelyn Bravo
(74) *Attorney, Agent, or Firm* — Bradley Arant Boult Cummings LLP

(57) ABSTRACT

The present disclosure provides improved protective headgear. The protective headgear includes a front shell attached to a back shell, where the front shell includes a crown portion, a forehead portion, opposite side face portions, and a jaw portion, and a shock absorbing member attached to the forehead portion and/or the jaw portion. The crown portion may include a padding insert disposed therein, where the padding includes a plurality of cutouts and is formed of a polymeric foam. The protective headgear may also include a faceguard that extends around the ear holes, which provides greater rigidity and allows for the headgear to absorb impact much more efficiently.

16 Claims, 16 Drawing Sheets

(56) References Cited

U.S. PATENT DOCUMENTS

| | | | | |
|---|---|---|---|---|
| 2013/0333100 | A1* | 12/2013 | Erb | A42B 3/125 2/425 |
| 2014/0115759 | A1* | 5/2014 | Tomlin | A63B 69/002 340/689 |
| 2014/0373257 | A1* | 12/2014 | Turner | A42B 1/0183 2/414 |
| 2016/0324247 | A1* | 11/2016 | Warmouth | A42B 3/20 |
| 2017/0079363 | A1* | 3/2017 | Durocher | A42B 3/324 |
| 2018/0042331 | A1* | 2/2018 | Bologna | A42B 3/128 |
| 2019/0014848 | A1* | 1/2019 | Tutunaru | A42B 3/0406 |
| 2019/0075878 | A1* | 3/2019 | Abraham | B32B 3/266 |
| 2021/0038966 | A1* | 2/2021 | Durocher | A42B 3/324 |
| 2022/0061448 | A1* | 3/2022 | Withnall | A42B 3/20 |
| 2022/0142284 | A1 | 5/2022 | Laperriere et al. | |
| 2023/0019358 | A1 | 1/2023 | Erb et al. | |
| 2023/0024564 | A1 | 1/2023 | Laperriere et al. | |

* cited by examiner

PROTECTIVE HEADGEAR

FIELD OF THE INVENTION

The present disclosure relates generally to protective headgear and masks. More particularly, the present disclosure relates to protective headgear and masks for baseball, softball, hockey, and other similar sports.

BACKGROUND OF THE INVENTION

Helmets are worn in sports and other activities to protect their wearers against head injuries. To that end, helmets typically include a rigid outer shell and inner padding to absorb energy when impacted. Baseball catchers are particularly prone to head injuries during play. A baseball catcher at virtually every level when catching behind home plate wears conventional protective equipment, such as leg guards, a chest protector and a catcher's mask. Generally, the catcher's mask includes a rigid outer shell, inner padding to absorb energy when impacted, and a cage having a relatively narrow viewing slot.

Conventional baseball catcher's masks have advantages, most importantly, being the overall protection afforded a catcher's face. However, the game is being played harder and faster every year, which requires improvements and advancements in the protection afforded by the helmets. For example, back swings are a serious threat to player safety. Catchers are continuously struck at the sides and rear of their heads by batters' follow through. The cages on the conventional catcher's masks do not fully protect against these unintended impacts. Conventional catcher's masks are also relatively heavy due to the material used to form the shells and the padding inserted within the shell. Moreover, conventional catcher's masks require improved shock absorbing properties to protect players from hard impacts. While the catcher's masks currently on the market are able to absorb some impact, improved shock absorbing properties are needed to absorb and displace impact from balls that are being hit faster and harder than before. Pitchers are also throwing balls faster and with more spin than ever before, which adds rotational energy and increases how hard the ball impacts the catcher's mask.

Accordingly, there remains a need in the art for improved lightweight protective headgear having enhanced structural stability and better shock absorption properties upon impact during sports play or other activities.

SUMMARY OF THE INVENTION

The problems expounded above, as well as others, are addressed by the following inventions, although it is to be understood that not every embodiment of the inventions described herein will address each of the problems described above.

In some embodiments, a protective headgear is provided, the protective headgear including a front shell operatively attached to a back shell, wherein the front shell and the back shell form an opening therebetween adapted to receive and protect a head of a wearer, the front shell including a crown portion, a forehead portion, opposite side face portions, and a jaw portion, a shock absorbing member attached to the front shell, the shock absorbing member including at least one of a first shock absorbing member attached to the forehead portion or a second shock absorbing member attached to the jaw portion, wherein the first shock absorbing member includes an outer portion curved to conform to an inner curvature of the forehead portion, a flange extending outwardly from the outer portion, a groove formed between the flange and the outer portion, wherein the forehead portion is configured to fit within the groove, and wherein the second shock absorbing member includes an outer surface having a substantially convex surface to conform to an inner curvature of the jaw portion and the outer surface is configured for attachment to the jaw portion.

In one embodiment, the first shock absorbing member further includes an inner portion attached to the outer portion, the inner portion having a curvature to conform to the curvature of the outer portion. In another embodiment, the inner portion is separated from the outer portion by a plurality of connectors forming segmented openings therebetween. In still another embodiment, the second shock absorbing member includes a lip extending outwardly from a lower edge of the outer surface and a groove formed between the lip and the outer surface, wherein the jaw portion is configured to fit within the groove. In yet another embodiment, the second shock absorbing member includes two outwardly protruding flaps attached to an upper edge of the outer surface, the two outwardly protruding flaps configured to fold over the jaw portion when positioned in the groove. In still another embodiment, each of the first and second shock absorbing members are formed of a material having a hardness of about 50 Shore A to about 80 Shore A. In another embodiment, the first shock absorbing member is formed of a material having a first hardness, the second shock absorbing member is formed of a material having a second hardness, and the first hardness is different from the second hardness. In yet another embodiment, each of the first and second shock absorbing members are formed of a material selected from the group consisting of ethylene vinyl acetate (EVA), vinyl nitrile, thermoplastic rubber (TPR), polypropylene (PP), expanded polypropylene (EPP), thermoset rubber (TSR), nitrile rubber, acrylonitrile butadiene styrene (ABS), PC/ABS compounds, styrene or high impact styrene (HIPS), and combinations thereof.

In further embodiments, a protective headgear is provided, the protective headgear including a front shell operatively attached to a back shell, wherein the front shell and the back shell form an opening therebetween adapted to receive and protect a head of a wearer, the front shell including a crown portion, a forehead portion, opposite side face portions, and a jaw portion, a shock absorbing member attached to the front shell, the shock absorbing member including at least one of a first shock absorbing member attached to the forehead portion or a second shock absorbing member attached to the jaw portion, and a padding insert disposed within the crown portion, wherein the padding insert includes a plurality of cutouts and the padding insert is formed of a polymeric foam selected from the group consisting of ethylene vinyl acetate (EVA), vinyl nitrile, high density polyethylene (HPDE) (HDPE), expanded polypropylene (EPP), expanded polyethylene (EPE), expanded polystyrene (EPS), polyurethane foam, and combinations thereof.

In one embodiment, the first shock absorbing member includes an outer portion curved to conform to an inner curvature of the forehead portion, a flange extending outwardly from the outer portion, a groove formed between the flange and the outer portion, wherein the forehead portion is configured to fit within the groove. In another embodiment, the second shock absorbing member includes an outer surface having a substantially convex surface to conform to an inner curvature of the jaw portion, a lip extending outwardly from a lower edge of the outer surface, and a groove formed between the lip and the outer surface, wherein the jaw portion is configured to fit within the groove. In still another embodiment, the padding insert is dimensioned to provide continuous protection of the crown portion. In yet another embodiment, the cutouts are substantially triangular shaped. In another embodiment, the back shell includes a lip positioned along a lowermost edge, the lip having an outwardly concave shape.

In still further embodiments, a protective headgear is provided, the protective headgear including a front shell operatively attached to a back shell, wherein the front shell and the back shell form an opening therebetween adapted to receive and protect a head of a wearer, the front shell including a face opening, a crown portion, a forehead portion, opposite side face portions having ear holes formed therein, and a jaw portion, a shock absorbing member attached to the front shell, the shock absorbing member including at least one of a first shock absorbing member attached to the forehead portion or a second shock absorbing member attached to the jaw portion, wherein each of the first and second shock absorbing members are formed of a material having a hardness of about 50 Shore A to about 80 Shore A, and a faceguard removably attached to the front shell, the faceguard including a plurality of horizontal and vertical wire members joined together, wherein at least two of the horizontal wire members are configured to extend past the face opening to meet at a location beyond the ear holes, thereby protecting an area surrounding the ear holes.

In one embodiment, the first shock absorbing member includes an outer portion curved to conform to an inner curvature of the forehead portion, a flange extending outwardly from the outer portion, a groove formed between the flange and the outer portion, wherein the forehead portion is configured to fit within the groove. In another embodiment, the second shock absorbing member includes an outer surface having a substantially convex surface to conform to an inner curvature of the jaw portion, a lip extending outwardly from a lower edge of the outer surface, and a groove formed between the lip and the outer surface, wherein the jaw portion is configured to fit within the groove. In still another embodiment, the protective headgear includes a padding insert disposed within the crown portion, the padding insert including a plurality of cutouts and formed of a polymeric foam. In yet another embodiment, the padding insert is formed of vinyl nitrile. In another embodiment, the back shell includes a lip positioned along a lowermost edge, the lip having an outwardly concave shape.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
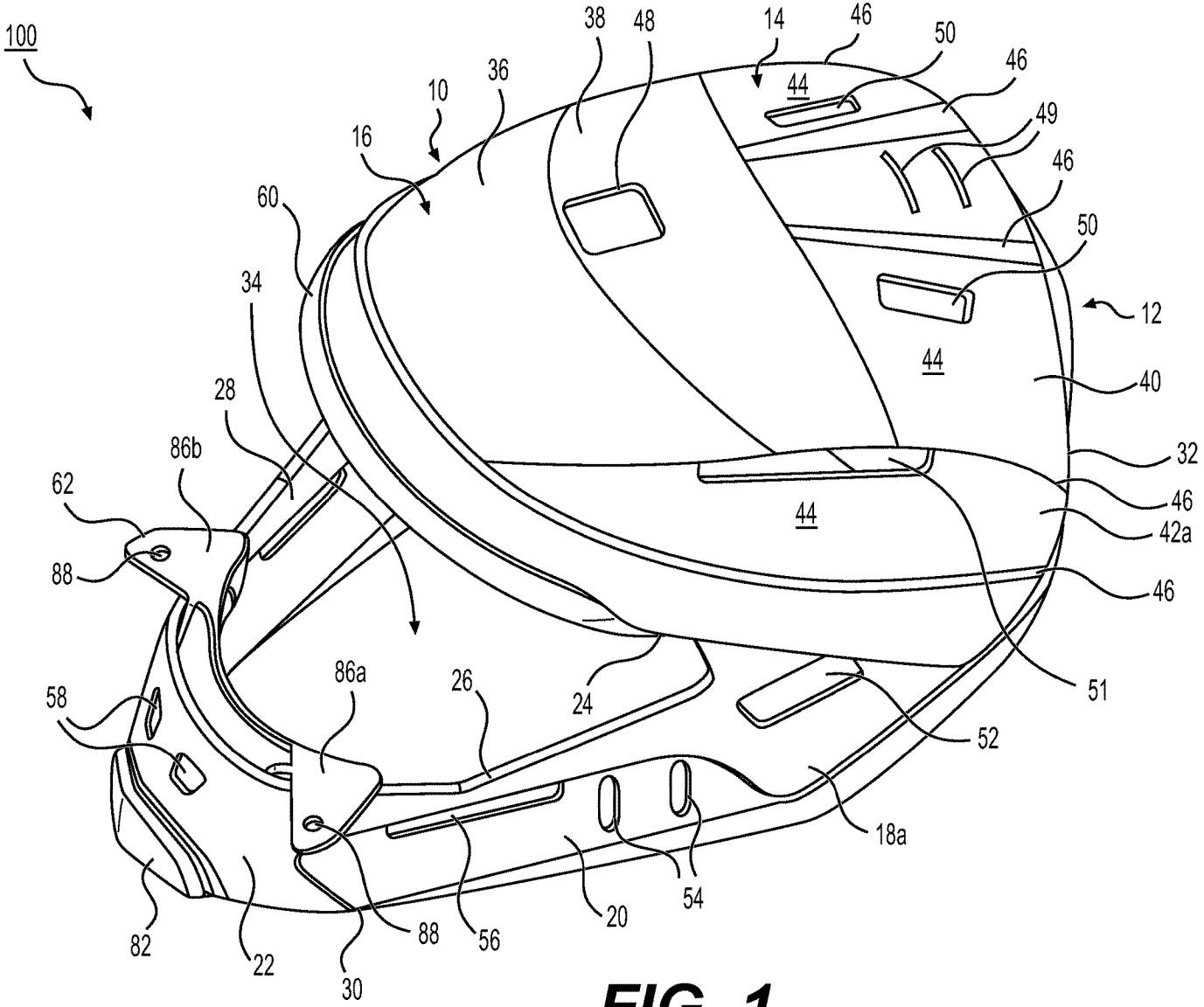
FIG. 1 is a front perspective view of a protective headgear according to one embodiment of the present disclosure.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The terms "first," "second," "third," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

Spatially relative terms, such as "above," "under," "below," "lower," "over," "upper," and the like, may be used herein for ease of description to describe one element or feature's relationship to another when the apparatus is right side up as shown in the accompanying drawings.

The term "substantially" allows for deviations from the descriptor that do not negatively impact the intended purpose. Descriptive terms are understood to be modified by the term "substantially" even if the word "substantially" is not explicitly recited.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The present disclosure provides improved protective headgear. In some embodiments, the protective headgear of the present disclosure is used for protecting the head of the wearer who is a sports player. For instance, the protective headgear may be worn by users playing a sport, such as baseball, hockey, lacrosse, football, bicycling, skiing, snowboarding, and horseback riding. In one embodiment, the protective headgear is used for protecting the head of a wearer who is playing baseball, such as a catcher. In other embodiments, the protective headgear may be worn by users for activities other than sports, such as motorcycling, industrial applications, military applications, and other activities in which protection against head injury is desired.

Referring to FIGS. 1-5, a protective headgear 100 according to one embodiment of the present disclosure is shown. The protective headgear 100 includes a front shell 10 and a back shell 12 adapted to receive and protect the head of a wearer. The front shell 10 and the back shell 12 are both concave-shaped to conform to the shape of the head of the wearer. In some embodiments, the front shell 10 and the back shell 12 are each of a single-piece construction and formed of a rigid polymeric material. For example, the front shell 10 and the back shell 12 may be formed of a suitable rigid polymeric material, such as polypropylene (PP), polycarbonate (PC), acrylonitrile butadiene styrene (ABS), PC/ABS compounds, styrene and/or high impact styrene (HIPS), nylon, polyethylene (PE), acetal copolymer (POM), or any combination of the foregoing.

The front shell 10 is defined by a crown portion 14, a forehead portion 16, and opposing side portions 18*a*, 18*b*. Each of the opposing side portions 18*a*, 18*b* includes a cheek portion 20 for protecting the sides of the wearer's face and a jaw portion 22 for protecting the jaw and chin of the wearer. The front shell 10 is bordered by a top front edge 24, a first side edge 26, a second side edge 28, a bottom edge 30, and a rear edge 32 that define an interior space for receipt of the wearer's head. A face opening 34 in the front shell 10 is defined by the top front edge 24, the first side edge 26, and the second side edge 28. A rear opening (not shown) is partially defined by the rear edge 32.

Figure 2:
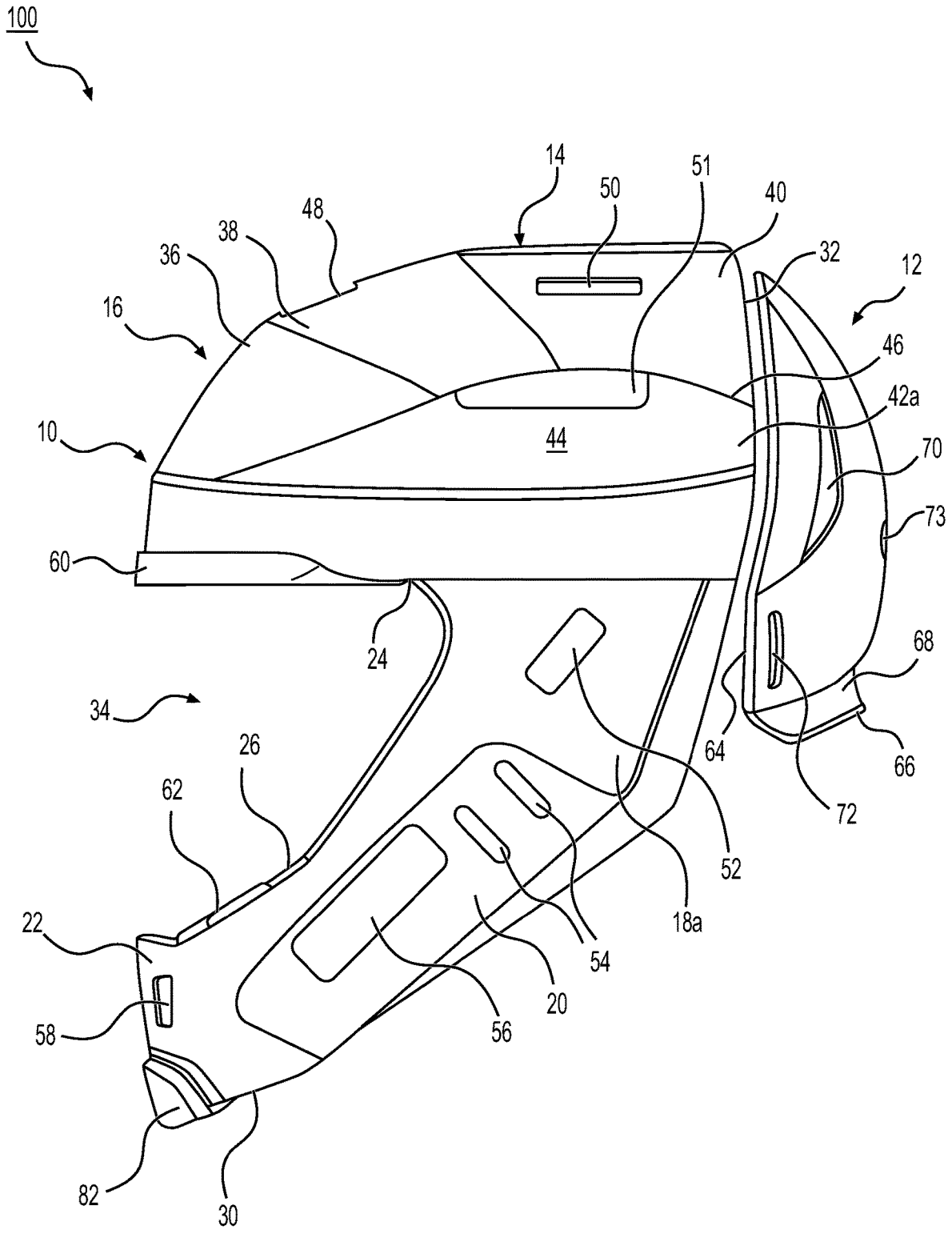
FIG. 2 is a side view of the protective headgear shown in FIG. 1.
Figure 3:
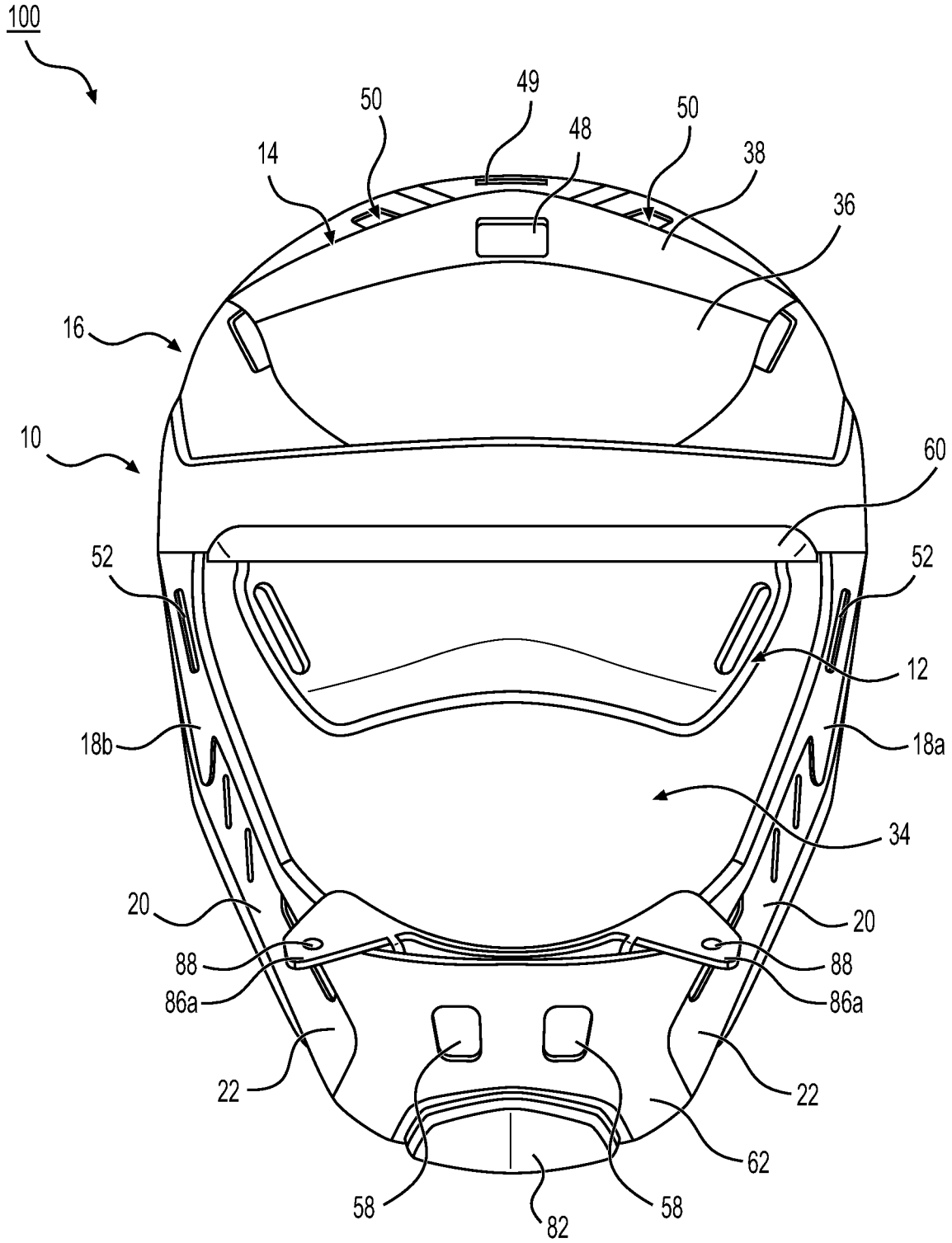
FIG. 3 is a front view of the protective headgear shown in FIG. 1.

The forehead portion 16 includes a central forwardmost wall portion 36. As best shown in FIG. 2, the central forwardmost wall portion 36 is generally inclined and blends into a flatter top wall portion 38. The inclined design of the forwardmost wall portion 36 helps deflect any objects, such as baseballs, that may directly impact the forehead portion of the front shell 10. The top wall portion 38 generally blends into a rear wall portion 40 of the crown portion 14. The crown portion 14 also includes a pair of lateral wall portions 42*a*, 42*b*. As illustrated in the Figures, the rear wall portion 40 and the lateral wall portions 42*a*, 42*b* may each include a plurality of flutes or valleys 44 and ribs 46 that emanate in a rearward direction. In this regard, the shape, dimensions, and number of valleys and ribs can vary and are not critical to the invention. In fact, the shape and dimensions of these areas are captured in a co-pending design patent application. The crown portion 14 may also include a pair of slots 49 in which a strap (not shown) may be looped through to articulately connect the front shell 10 to the back shell 12.

The front shell 10 may include a plurality of openings for ventilation purposes. In this regard, the shape, dimensions, and number of the openings are not critical to the invention. For example, an opening may be circular, rectangular, triangular, diamond, oval, etc. In some embodiments, ventilation openings in the front shell 10 may include a ventilation hole 48 centrally located in the top wall 38 of the crown portion 14 and ventilation holes 50 located on the left side and right side of the rear wall portion 40 of the crown portion 14. Ventilation holes 51 may be located on each of the lateral wall portions 42*a*, 42*b*. The front shell 10 may also have an ear hole 52 on each of the side portions 18*a*, 18*b*. Slots 54 are formed in each of the side portions 18*a*, 18*b* for passage of a strap of a strap harness (not shown) to connect the back shell 12 with the front shell 10 in use. The cheek portion 20 of each of the side portions 18*a*, 18*b* may have a ventilation hole 56. The jaw portion 22 on each of the side portions 18*a*, 18*b* may also have a ventilation hole 58.

As will be described in more detail below, the front shell 10 may include one or more shock absorbing members, such as one or more protective hammocks, that provide additional shock absorbing properties for the wearer of the protective headgear 100 upon impact of an object. In some embodiments, the front shell 10 may include a forehead hammock 60, a chin hammock 62, or both attached thereto. Among other benefits and without being bound by any particular theory, each of the forehead hammock 60 and the chin hammock 62 help isolate the wearer's head from energy caused by direct impacts by absorbing and displacing unwanted energy on impact.

As illustrated in FIG. 1 and discussed in more detail below, the front shell 10 may include a forehead hammock 60. In this aspect, the forehead hammock 60 is attached to the forehead portion 16 along the top front edge 24. The forehead hammock 60 is designed to absorb the impact force of an object that hits the forehead portion 16 or crown portion 14. As shown in FIG. 1, the front shell 10 may also include a chin hammock 62. The chin hammock 62 is attached to each of the jaw portions 22 of the side portions 18*a*, 18*b*. The chin hammock 62 is designed to absorb the impact force of an object that hits the cheek portion 20 or jaw portion 22. In some embodiments, the front shell 10 includes both forehead and chin hammocks 60 and 62. Both the forehead hammock 60 and the chin hammock 62 are shock absorbing members adapted to substantially distribute an impact force exerted on the protective headgear 100 through the front shell 10.

Figure 4:
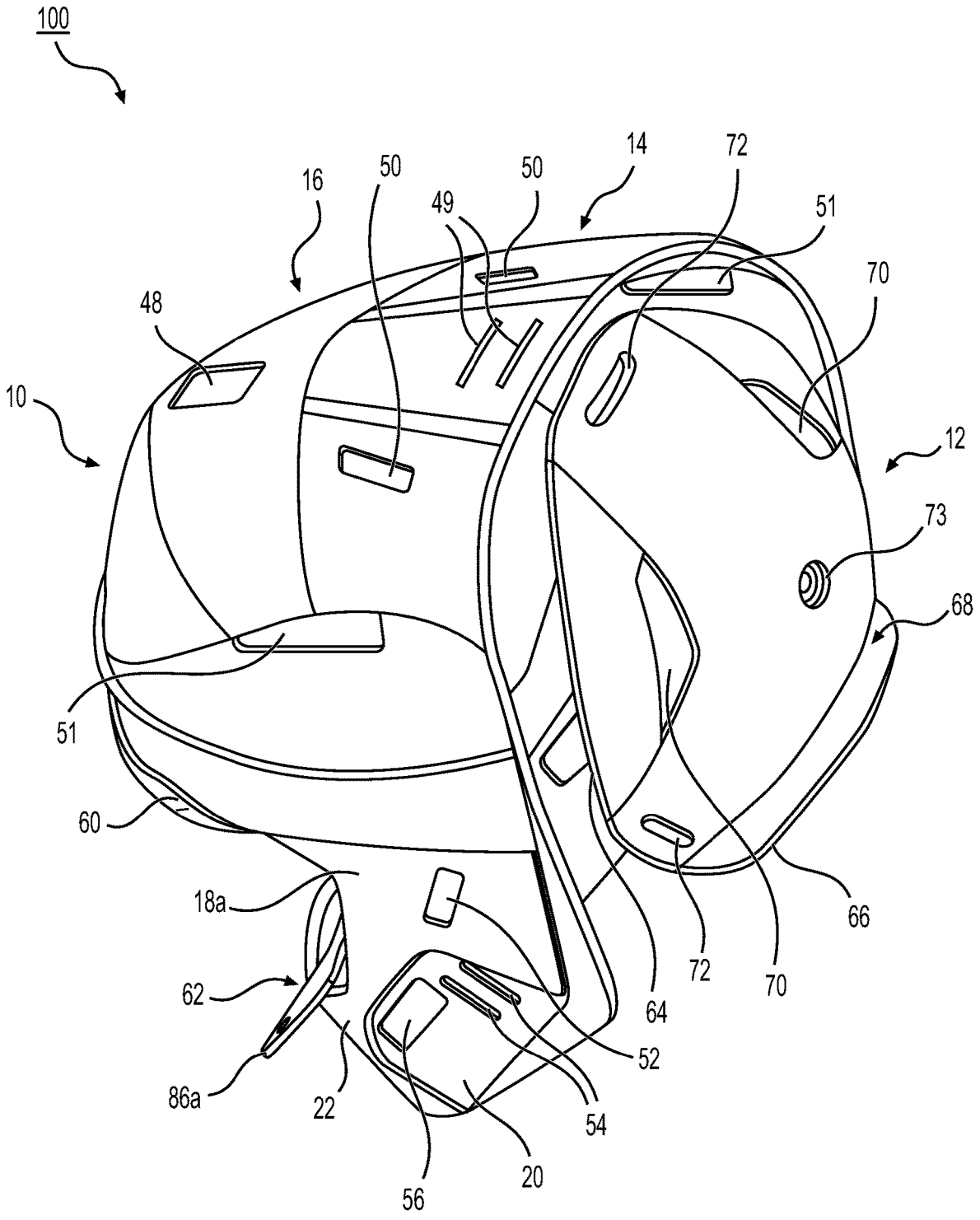
FIG. 4 is a back perspective view of the protective headgear shown in FIG. 1.
Figure 5:
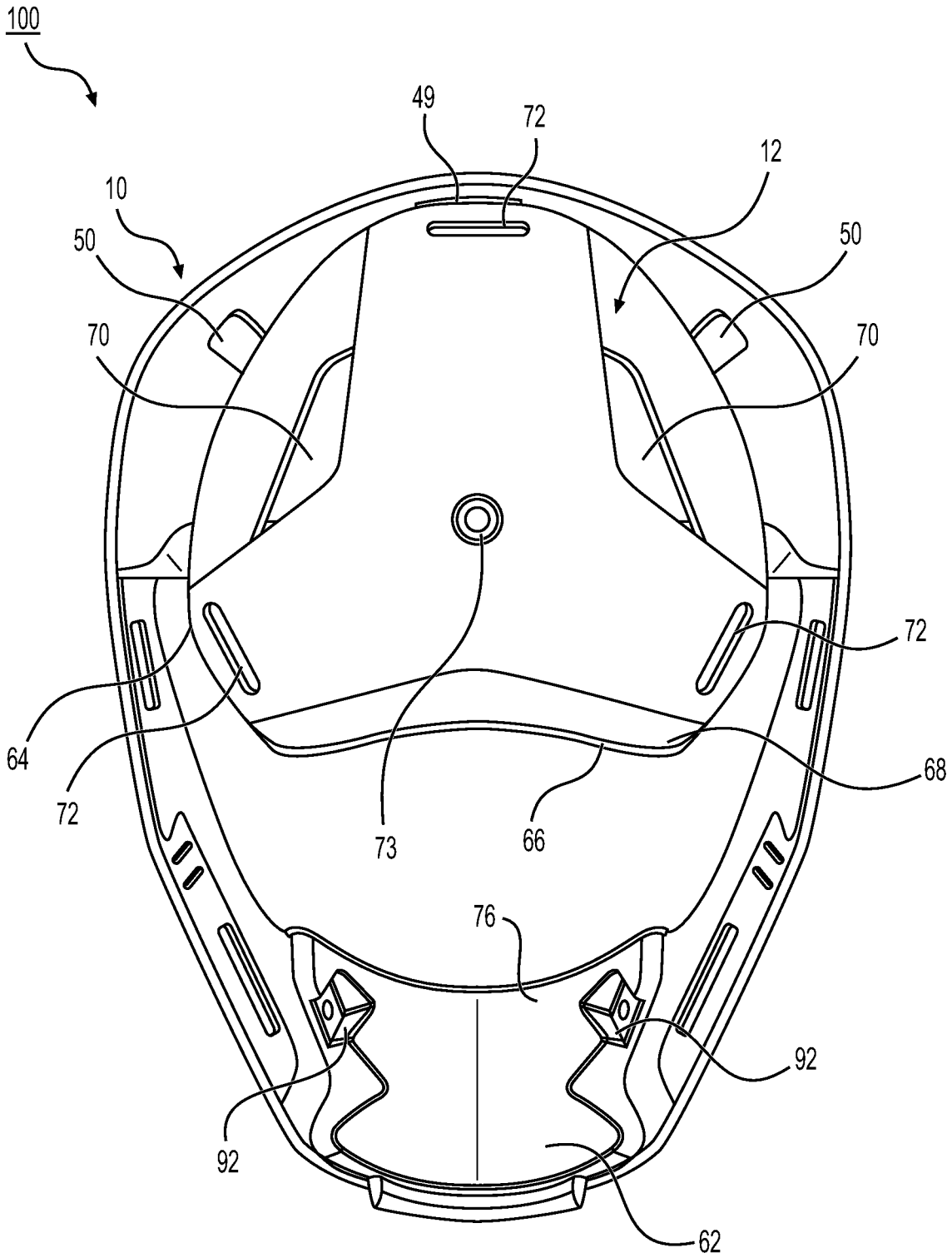
FIG. 5 is a back view of the protective headgear shown in FIG. 1.
Figure 6:
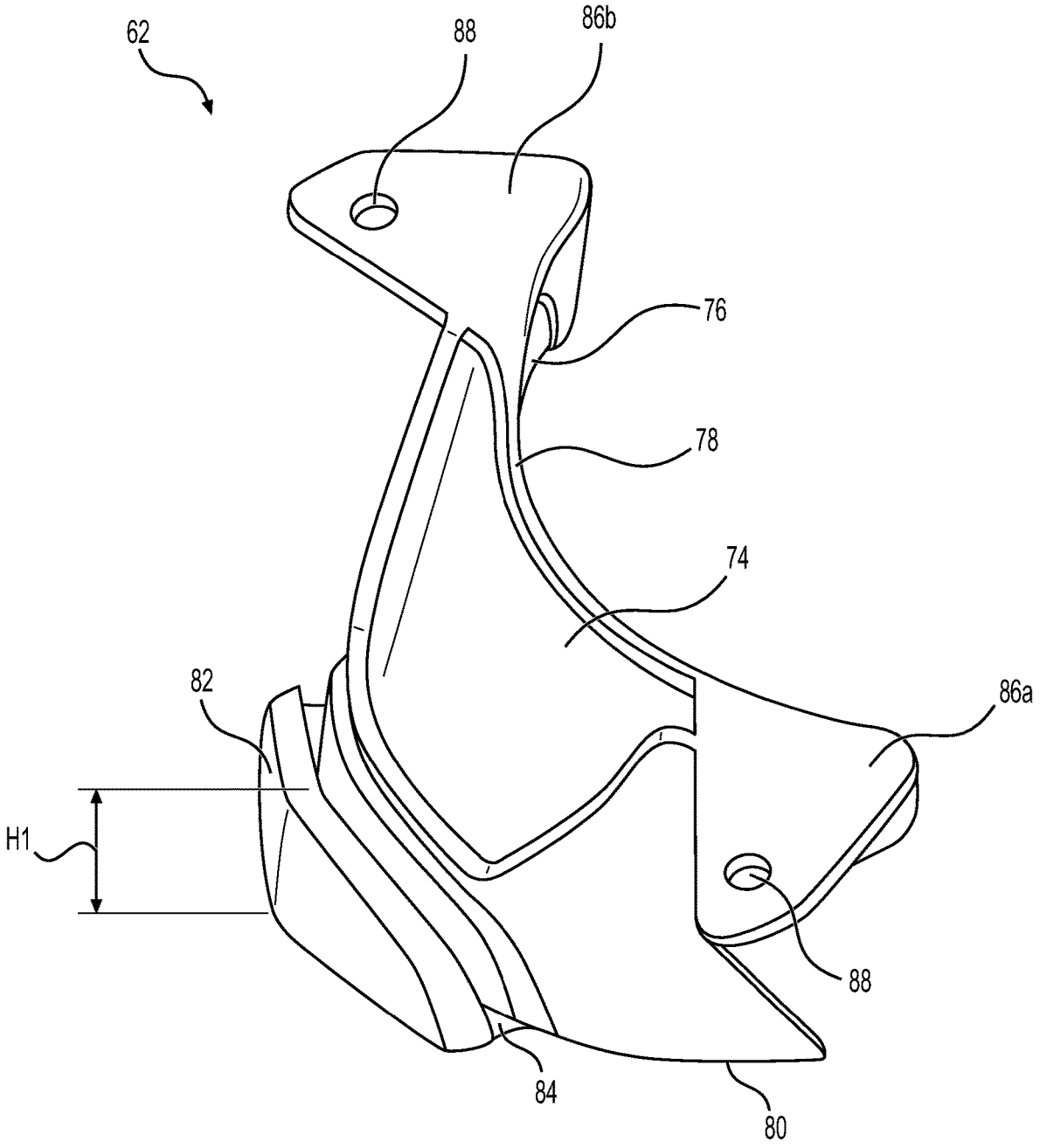
FIG. 6 is a front perspective view of a chin hammock according to one embodiment of the present disclosure.

As best shown in FIGS. 4 and 5, the back shell 12 has a concave configuration to generally conform to the contour of the back of the wearer's head. The back shell 12 has a continuous edge 64 that blends with a lowermost terminal edge 66 defining a bottom of the back shell 12. In some embodiments, a lip or flange 68 may be provided around the lowermost terminal edge 66. In the illustrated embodiment, the lip 68 has an outwardly concave shape that provides additional rigidity to the back shell 12 and comfortability to the wearer. However, if included, the lip 68 may have other shapes. The back shell 12 may also include an area 73 positioned in the center of back shell 12. The area 73 may be shaped to receive or identify a location for a cover mechanism, such as a plate, decal, or logo. In the illustrated embodiment, the area 73 is circular. However, the area 73 may have any shape, such as rectangular, diamond, or triangular, to accommodate the shape of the cover mechanism received therein. In some embodiments, as shown in FIG. 4, the area 73 may be recessed.

Similar to the front shell 10, the back shell 12 may include a plurality of openings for ventilation purposes. In this regard, the shape, dimensions, and number of the openings can vary and are not critical to the invention. In fact, an opening may have any number of shapes including, but not limited to circular, rectangular, triangular, diamond, and oval. As shown in the embodiment illustrated in FIGS. 4 and 5, the back shell 12 may include two ventilation holes 70 positioned on a left side and a right side and formed therein. The back shell 12 also includes a plurality of slots 72 formed therein for receiving straps of a strap harness (not shown) to releasably attach the back shell 12 to the front shell 10. In the illustrated embodiment, the back shell 12 includes three slots 72: one positioned at an upper portion and two positioned on opposite lower lateral edges. One or more straps and adjusting buckles (generally shown in FIG. 19) may be provided for articulately connecting the back shell 12 to the front shell 10. For example, a strap may be looped through the upper slot 72 on the back shell 12 and the pair of slots 49 on the front shell 10 to articulately connect the back shell 12 to the front shell 10. The straps may be threaded through the slots 72 and through a buckle which can be used to size the overall volume of the protective headgear 100. The straps also permit the back shell 12 to pivot rearwardly from the closed position (shown in FIG. 4) to an open position (not shown) or to be entirely removed from the protective headgear 100.

FIGS. 6-9 show the chin hammock 62 according to one embodiment of the present disclosure. The chin hammock 62 of the present disclosure has shock absorbing properties that allows it to act as a buffer zone and disperse impact as an object hits the protective headgear 100, and thus, reduces the impact force transferred to the wearer. The chin hammock 62 may be detachably or permanently secured to the protective headgear 100 near the jaw portion 22. As illustrated in FIGS. 6-9, the chin hammock 62 has an outer surface 74 and an inner surface 76. The outer surface 74 has a substantially convex surface and the inner surface 76 has a substantially concave surface, both surfaces extending along upper and lower edges 78, 80. The upper and lower edges 78, 80 are arcuate and have a substantially uniform radius of curvature configured to follow the general shape of the wearer's chin. The concave inner surface 76 is generally shaped to provide a cup-shaped pocket configured to receive the wearer's chin therein. A chin pad (not shown) may be removably attached to the inner surface 76 so that the wearer's chin does not directly contact the chin hammock 62.

Figure 7:
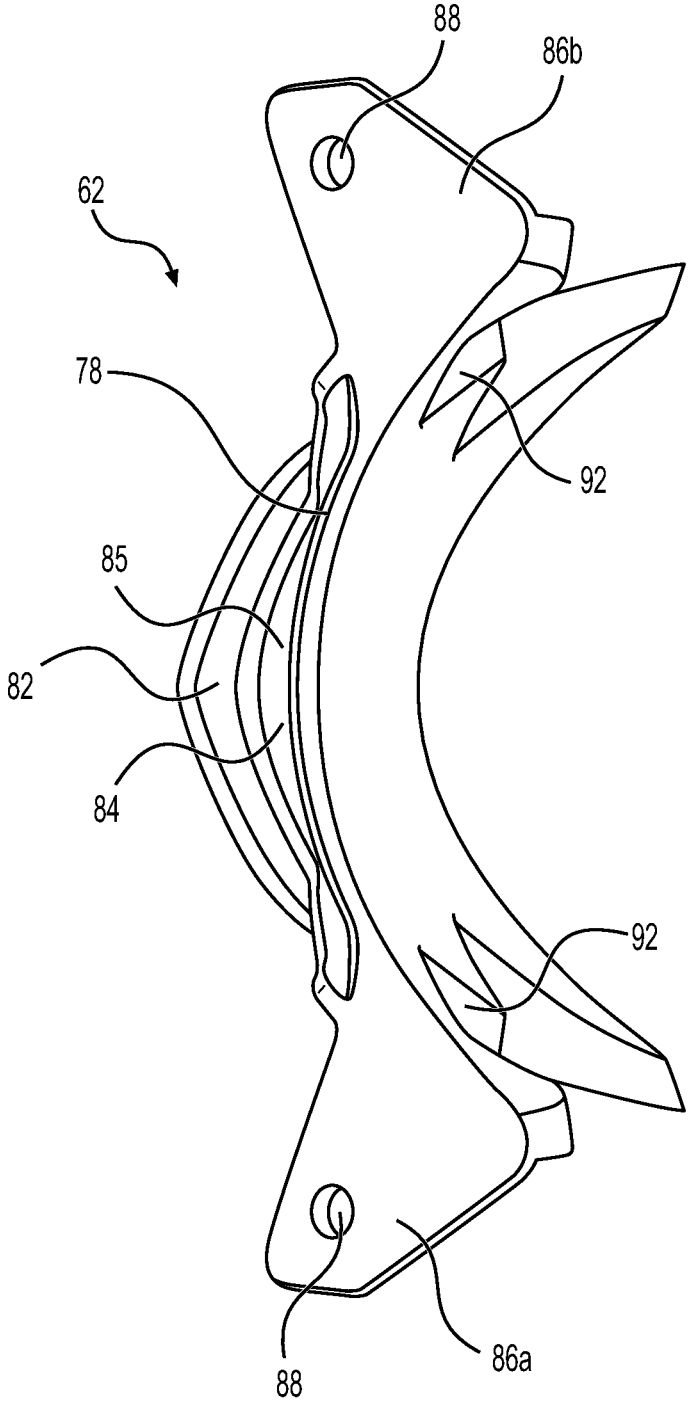
FIG. 7 is a top view of the chin hammock shown in FIG. 6.

The chin hammock 62 may also include a lip 82 extending outwardly from the lower edge 80 in a frontward direction. The lip 82 has a height H sufficient to secure the chin hammock 62 in position when attached to the protective headgear 100. In some embodiments, the lip 82 has a height H of about 0.125 inches to about 1.5 inches. For example, the lip 82 may have a height H of about 0.25 inches to about 1 inch. In another embodiment, the lip 82 may have a height H of about 0.5 inches to about 1 inch. A groove 84 is formed between the lip 82 and the outer surface 74. As shown in FIG. 7, the groove 84 may have a bottom surface 85 that is at least partially open such that an empty space is formed between the lip 82 and the outer surface 74. The chin hammock 62 also includes two outwardly protruding flaps 86*a*, 86*b* positioned on each end of the upper edge 78. When the chin hammock 62 is attached to the protective headgear 100 (as shown in FIG. 1), the bottom edge 30 of the jaw portion 22 is configured to fit within the groove 84 such that the lip 82 is positioned on the outside of the jaw portion 22 and the outer surface 74 of the chin hammock 62 is positioned against the inside of the jaw portion 22. In this configuration, the flaps 86*a*, 86*b* are positioned to fold over the side edges 26, 28. Due to the ability of the lip 82 and the flaps 86*a*, 86*b* to essentially wrap around the jaw portion 22, the lip 82 and the flaps 86*a*, 86*b* serve as bushings between the front shell 10 and the faceguard 200 to help dampen the energy transmitted through the bushing upon impact by an object. The lip 82 and the flaps 86*a*, 86*b* also provide additional insulation for the protective headgear 100 that helps reduce external noise for the wearer.

Figure 8:
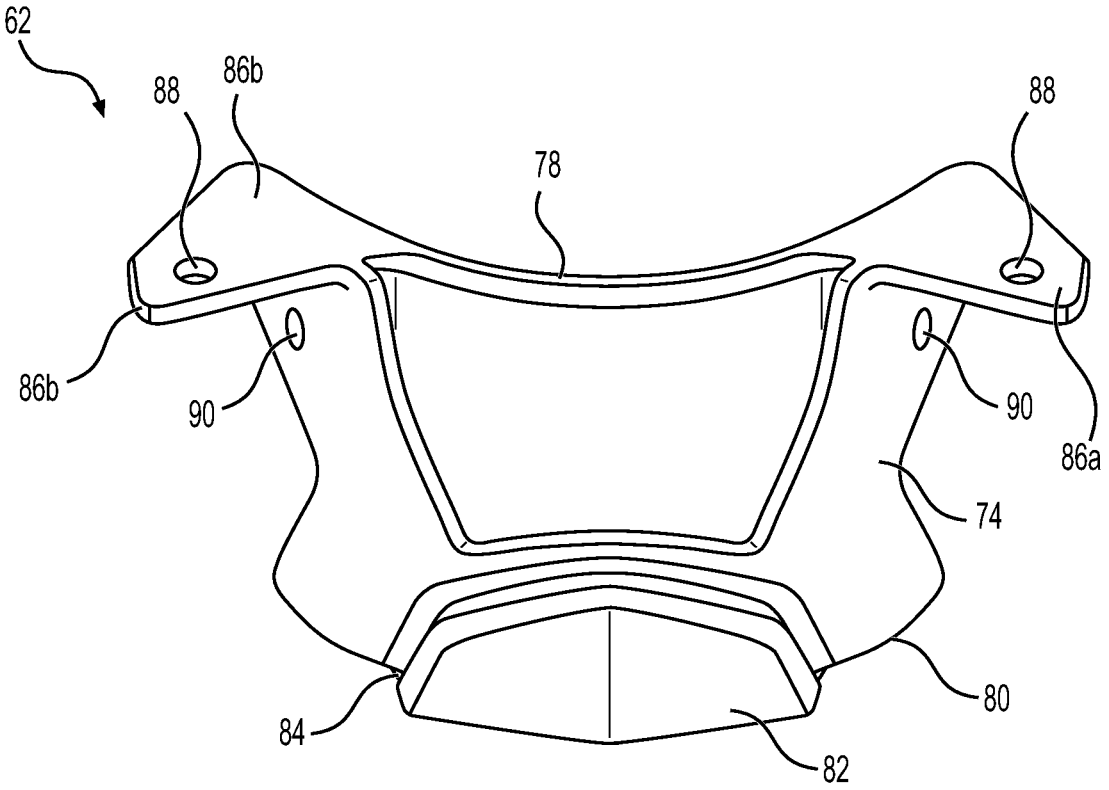
FIG. 8 is a front view of the chin hammock shown in FIG. 6.
Figure 9:
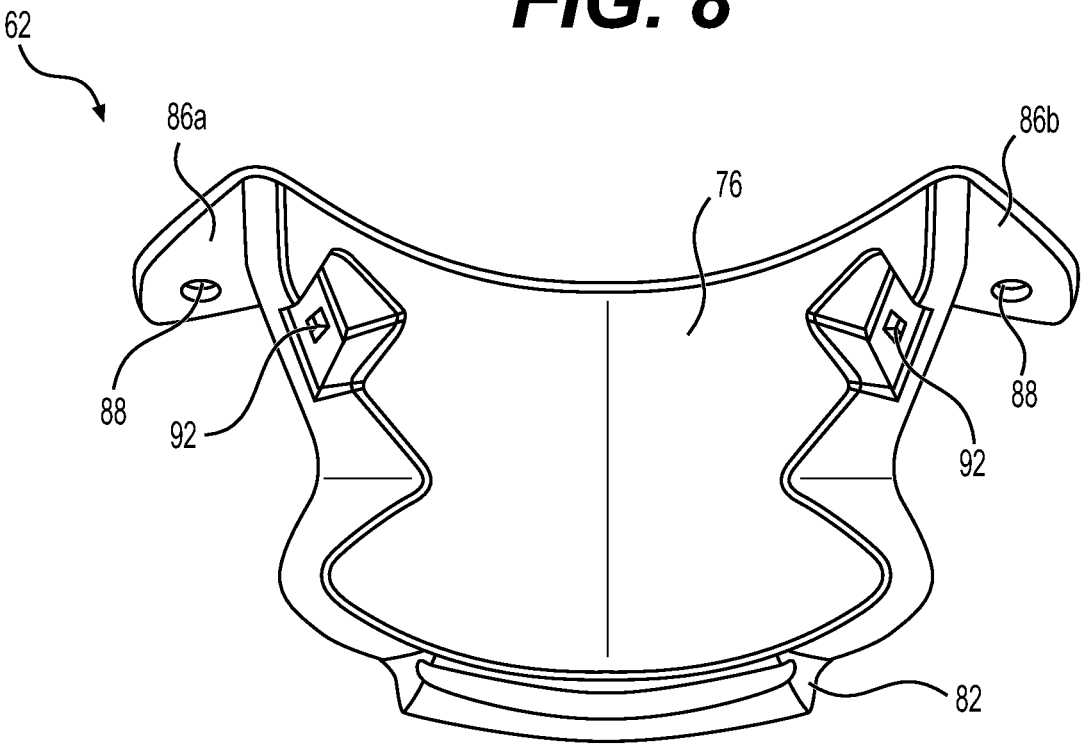
FIG. 9 is a back view of the chin hammock shown in FIG. 6.
Figure 19:
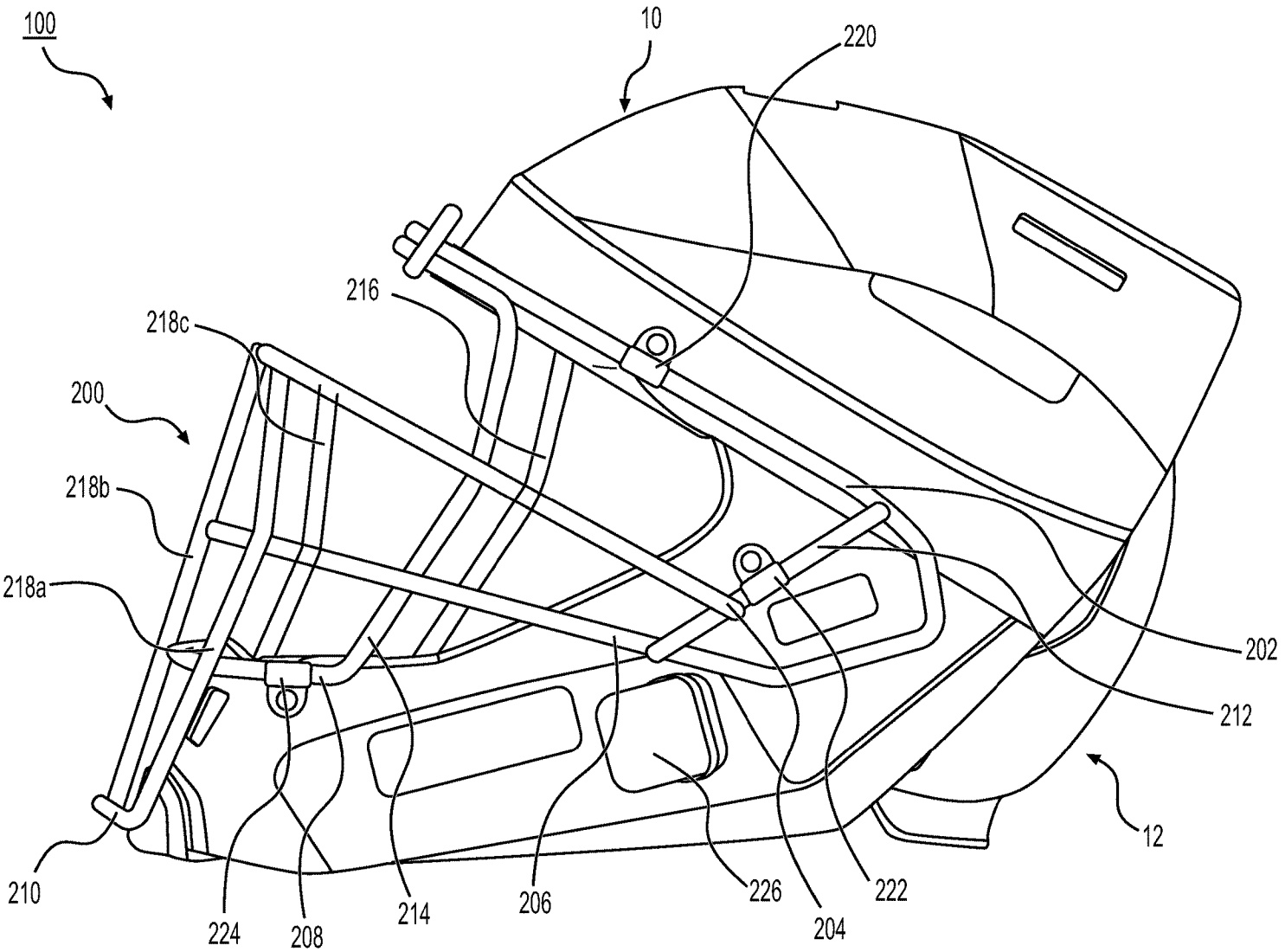
FIG. 19 is a side view of the protective headgear having a faceguard attached thereto according to one embodiment of the present disclosure.

Each of the flaps 86*a*, 86*b* include an attachment hole 88 for receiving a fastener, such as a bolt or screw, to secure a faceguard to the protective headgear 100, as will be described in more detail below. As shown in FIGS. 8 and 9, the chin hammock 62 also includes attachment holes 90 within the outer and inner surfaces 74, 76, that are positioned in alignment with each of the attachment holes 80 when the flaps 86*a*, 86*b* are folded over. Recessed holes 92 surround each of the attachment holes 90 on the inner surface 76, as illustrated in FIG. 9. In use, when a faceguard is attached to the protective helmet 100, a fastener on the faceguard, such as a bolt or a screw, can be received in the attachment holes 88 of the flaps 86*a*, 86*b* and inserted through the front shell 10 and attachment holes 90 on the chin hammock 62 to secure the faceguard to the front shell 10, as generally shown in FIG. 19 which is described in detail below. A threaded fastener, such as a T-nut fastener, may be inserted into recessed holes 92 to secure the fastener in place.

Figure 10:
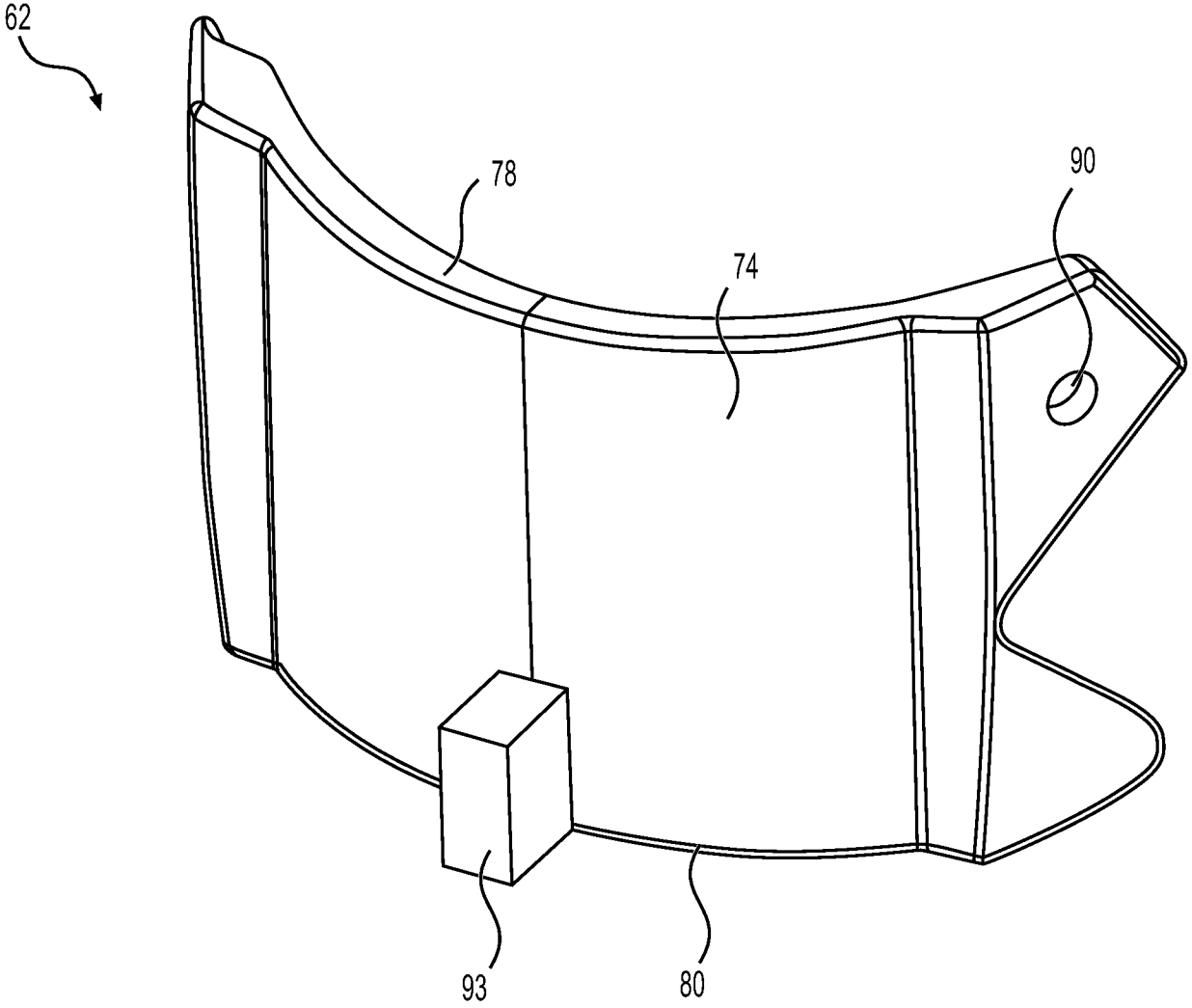
FIG. 10 is a front perspective view of a chin hammock according to another embodiment of the present disclosure.

FIG. 10 shows the chin hammock 62 according to another embodiment of the present disclosure. As illustrated in FIG. 10, the chin hammock 62 has the outer surface 74 and the inner surface 76 extending along upper and lower edges 78, 80, as described above. However, in this embodiment, the chin hammock 62 does not include the lip or the flaps. Without the use of the lip or flaps, the chin hammock 62 is more light weight and reduces the overall weight of the protective headgear 100.

As shown in FIG. 10, the lateral edges of the outer and inner surfaces 74, 76 may include the attachment holes 90. The recessed holes 92 may surround each of the attachment holes 90 on the inner surface 76. In use, when a faceguard is attached to the protective helmet 100, a fastener on the faceguard, such as a bolt or a screw, can be inserted through the front shell 10 and attachment holes 90 on the chin hammock 62 to secure the faceguard to the front shell 10. In some embodiments, each bottom corner 77 may also be attached to the front shell 10 for added support. The bottom corners 77 may be secured to the front shell 10 using an adhesive, such as glue, or mechanically fastened. The chin hammock shown in FIG. 10 may also include a protrusion 93 extending outwardly from the lower edge 80 in a frontward direction. The protrusion 93 is configured to contact the front shell 10 to prevent the chin hammock 62 from stretching too far.

Figure 11:
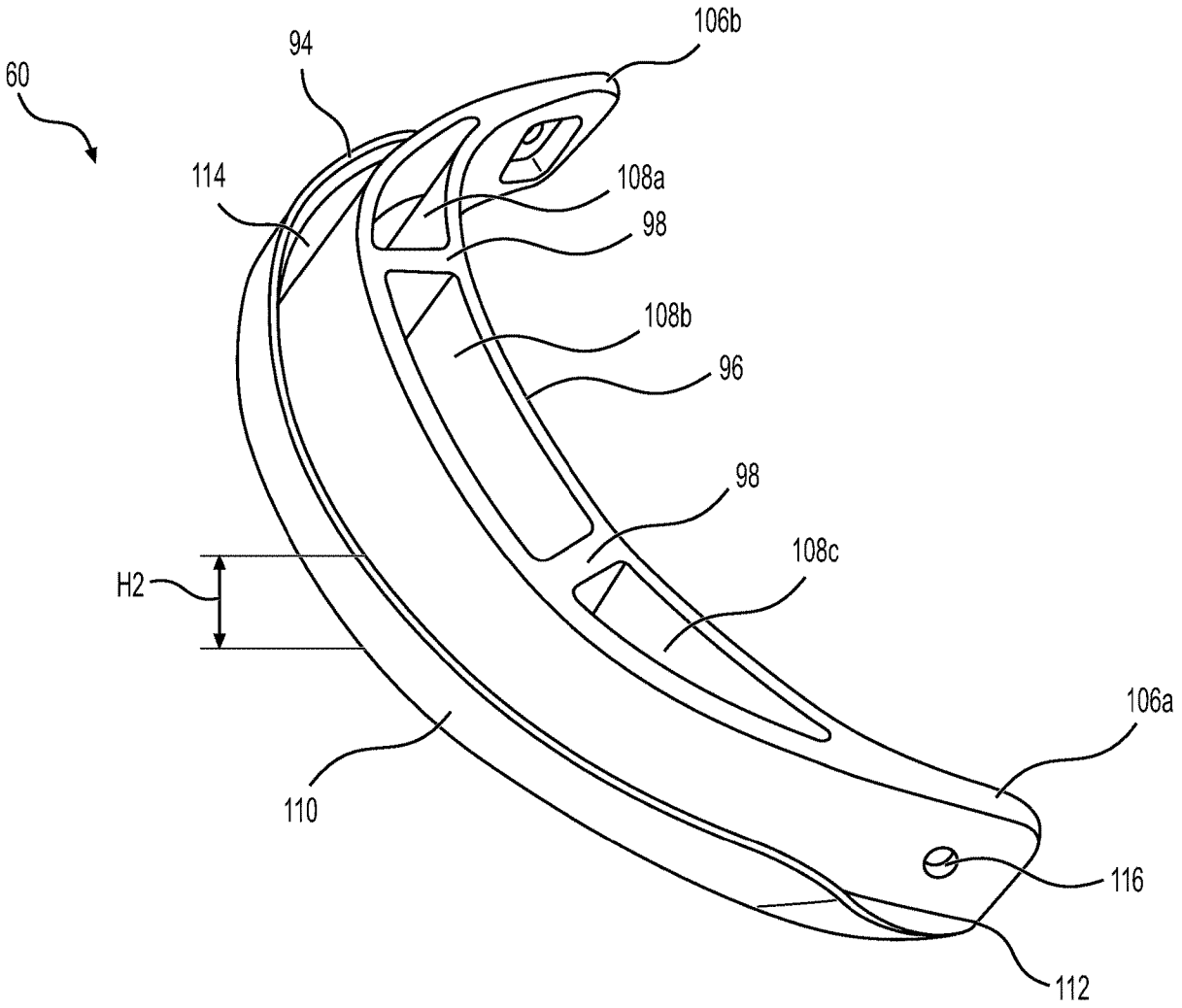
FIG. 11 is a front perspective view of a forehead hammock according to one embodiment of the present disclosure.
Figure 12:
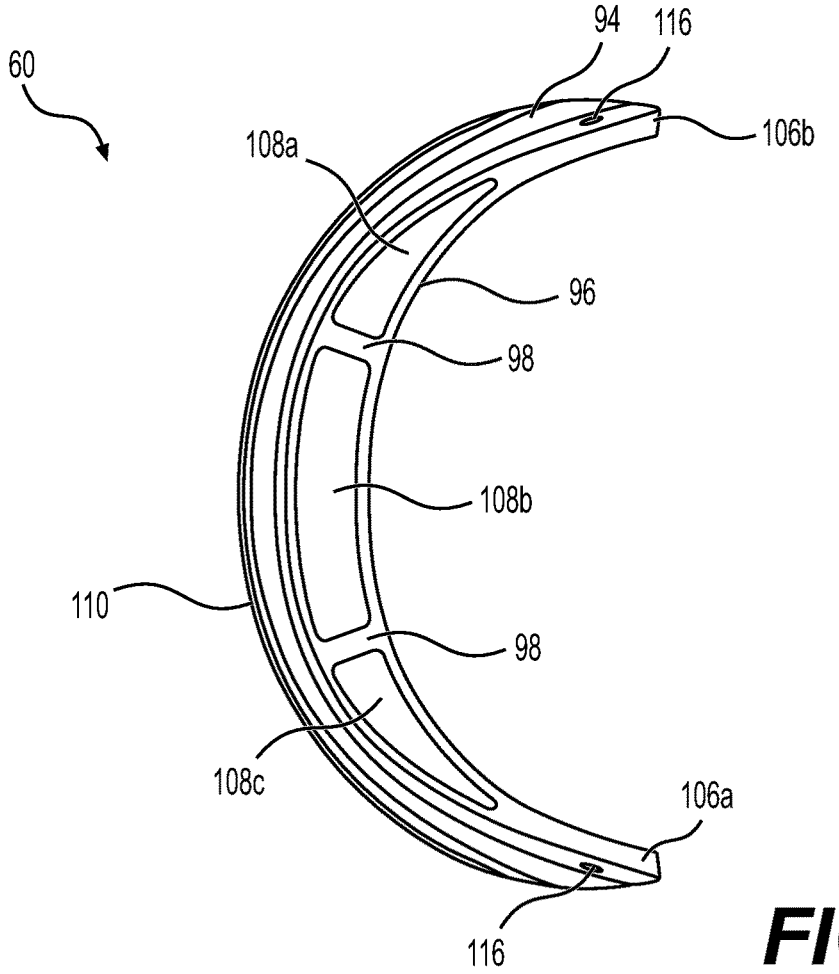
FIG. 12 is a top view of the forehead hammock shown in FIG. 10.
Figure 13:
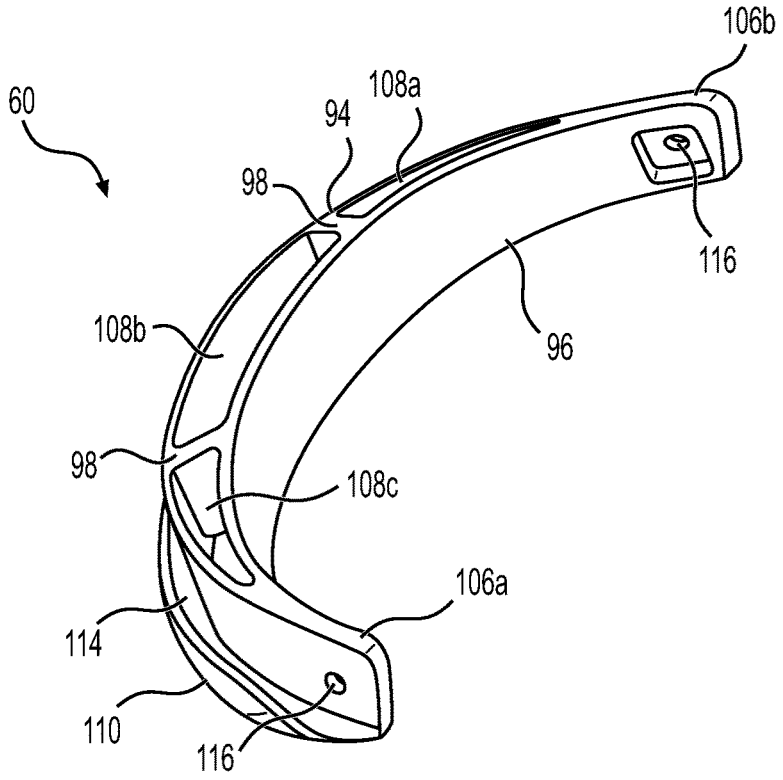
FIG. 13 is a back perspective view of the forehead hammock shown in FIG. 10.

FIGS. 11-13 show the forehead hammock 60 according to one embodiment of the present disclosure. Like the chin hammock 62, the forehead hammock 60 of the present disclosure has shock absorbing properties that help reduce the impact force transferred to the wearer upon impact to the front shell 10. The forehead hammock 60 may be detachably secured to the protective headgear 100 along the top front edge 24.

As shown in FIGS. 11-13, the forehead hammock 60 is crescent-shaped and formed of an outer, larger curved portion 94 attached to an inner, smaller curved portion 96. The outer curved portion 94 is attached to the inner curved portion 96 at ends 106*a*, 106*b*. A forehead pad (not shown) may be removably attached to the inner curved portion 96 so that the wearer's head does not directly contact the forehead hammock 60. In the illustrated embodiment, the ends of the outer curved portion 94 and the inner curved portion 96 are integrally formed with one another to form ends 106*a*, 106*b*. The outer curved portion 94 is separated from the inner curved portion 96 by connectors 98 that form segmented openings 108*a*, 108*b*, 108*c* in between the outer and inner curved portions 94, 96. The connectors 98 help keep the inner curved portion 96 flush with the top front edge 24. As best shown in FIG. 12, the outer curved portion 94 is separated from the inner curved portion 96 by two connectors 98. The two connectors 98 are spaced apart to form three openings 108*a*, 108*b*, 108*c*. The connectors 98 and the openings 108*a*, 108*b*, 108*c* help dampen the energy transmitted through the front shell 10 upon impact by an object. As will be appreciated by those of ordinary skill in the art, any number of connectors (and openings formed therebetween) may be used with the forehead hammock 60 of the present disclosure. In some embodiments, no connectors may be necessary on the forehead hammock 60.

The forehead hammock 60 may have a flange 110 extending outwardly from a lower edge 112 of the outer curved portion 94. The flange 110 extends the entire length of the lower edge 112. The flange 110 has a height H2 sufficient to secure the forehead hammock 60 in position when attached to the protective headgear 100. In some embodiments, the flange 110 has a height H2 of about 0.125 inches to about 0.75 inches. For example, the flange 100 may have a height H2 of about 0.25 inches to about 0.5 inches. A groove 114 is formed between the flange 110 and the outer curved portion 94. When the forehead hammock 60 is secured to the protective headgear 100 (as shown in FIG. 1), the top front edge 24 is configured to fit within the groove 114 such that the flange 110 is positioned on the outside of the forehead portion 16 and the outer and inner curved portions 94, 96 are positioned on the inside of the forehead portion 16.

Each end 106*a*, 106*b* includes an attachment hole 116 for receiving a fastener, such as a bolt or screw, to secure the forehead hammock 60 to the protective headgear 100. In some embodiments, the attachment holes 116 may be used to secure a faceguard to the protective headgear 100 (in addition to securing the forehead hammock 60 to thereto). For instance, when a faceguard is attached to the protective headgear 100, a fastener on the faceguard, such as a bolt or a screw, can be inserted through the front shell 10 and the attachment holes 116 on the forehead hammock 60 to secure the faceguard and the forehead hammock 60 to the front shell 10, as generally shown in FIG. 19 which will be described in more detail below.

While the forehead hammock 60 has been illustrated herein to include attachment holes for receiving a mechanical fastener to secure the forehead hammock 60 to the front shell 10, other mechanisms for securing the forehead hammock 60 may also be used. For instance, the forehead hammock 60 may be welded to the front shell 10. In other embodiments, the forehead hammock 60 may be secured to the front shell 10 using an adhesive, such as glue. In still other embodiments, the forehead hammock 60 may be secured to the front shell 10 using one or more hook and loop fasteners.

Figure 14:
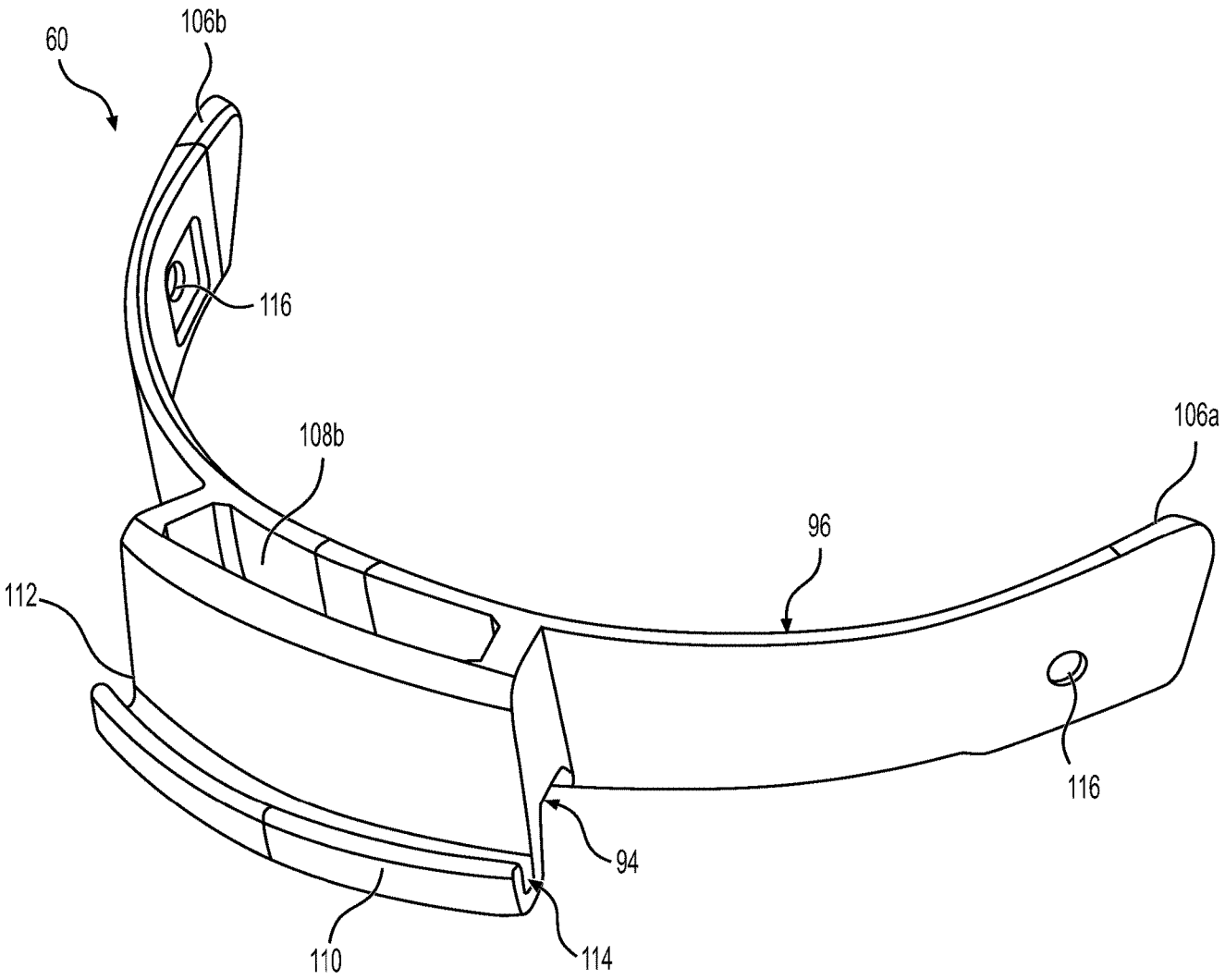
FIG. 14 is a front perspective view of a forehead hammock according to another embodiment of the present disclosure.

FIG. 14 shows the forehead hammock 60 according to another embodiment of the present disclosure. As shown in FIG. 14, the forehead hammock 60 is crescent-shaped and includes the inner curved portion 96 with the outer curved portion 94 attached thereto. However, in this embodiment, the outer curved portion 94 is substantially reduced such that a single segmented opening 108*b* is formed between the outer and inner curved portions 94, 96. The reduction in size of the outer curved portion 94 reduces the weight of the forehead hammock 60 and the overall weight of the protective headgear 100. The outer curved portion 94 includes the flange 110 extending outwardly from the lower edge 112 of the outer curved portion 94 and the groove 114 formed between the flange 110 and the outer curved portion 94 for attachment to the protective headgear 100. The ends 106*a*, 106*b* of the outer curved portion 94 may also include the attachment holes 116 for receiving a fastener, such as a bolt or screw, to secure the forehead hammock 60 to the protective headgear 100.

Figure 15:
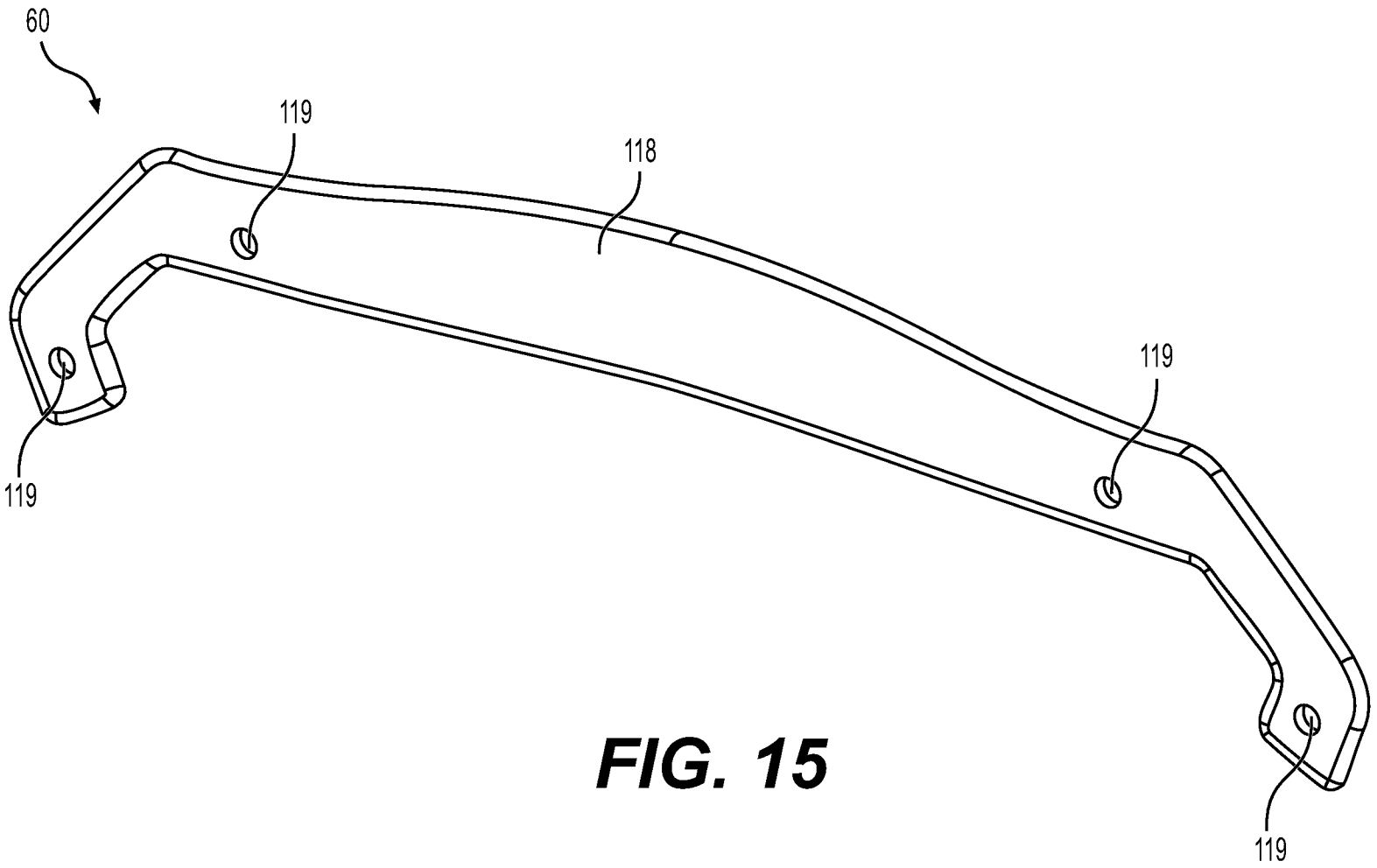
FIG. 15 is a front perspective view of a forehead hammock according to still another embodiment of the present disclosure.

FIG. 15 shows the forehead hammock 60 according to still another embodiment of the present disclosure. In this embodiment, the forehead hammock 60 is designed as a flat band 118 having a plurality of attachment holes 119. The flat band 118 may be detachably secured to the protective headgear 100 along the top front edge 24 using the attachment holes 119. A fastener, such as a bolt or screw, can be inserted into the attachment holes 119 to secure the forehead hammock 60 to the protective headgear 100.

The forehead hammock 60 and the chin hammock 62 may be formed of any suitable material that allows for the hammocks 60, 62 to absorb, or attenuate, the impact force exerted upon the protective headgear 10, and to substantially distribute the impact force through the front shell 10. Indeed, the forehead hammock 60 and the chin hammock 62 may be formed of any suitable material that is able to isolate the wearer's head from external impacts by distributing the impact force along each of the inner surfaces of the hammocks. In use, a point load on the front shell 10 pushes the hammocks 60, 62 into the wearer's head, thereby spreading the force much more broadly than a traditional shell configuration.

The forehead and chin hammocks may be formed of the same or different materials. In some embodiments, the forehead hammock 60 and the chin hammock 62 may be formed of a material having a hardness of about 50 Shore A to about 80 Shore A. In further embodiments, the forehead hammock 60 and the chin hammock 62 may be formed of a material having a hardness of about 55 Shore A to about 75 Shore A. In still further embodiments, the forehead hammock 60 and the chin hammock 62 may be formed of a material having a hardness of about 60 Shore A to about 65 Shore A. For instance, the forehead hammock 60 and the chin hammock 62 may be formed of a material having a hardness of about 65 Shore A. In some embodiments, the material of the forehead hammock 60 and the material of the chin hammock 62 have the same hardness value. In other embodiments, the material of the forehead hammock 60 and the material of the chin hammock 62 have different hardness values.

Suitable materials for forming the forehead hammock 60 and the chin hammock 62 of the present disclosure include, but are not limited to, thermoplastic rubber (TPR), polypropylene (PP), expanded polypropylene (EPP), thermoset rubber (TSR), nitrile rubber, acrylonitrile butadiene styrene (ABS), PC/ABS compounds, styrene and/or high impact styrene (HIPS), vinyl nitrile, ethylene vinyl acetate (EVA), and any combination of the foregoing materials. The materials may be made using any type of molding process, including compression molding, injection molding, casting, and blow molding. The materials may also be made using 3D printing techniques, such as lattices. In one embodiment, the forehead hammock 60 and the chin hammock 62 may be formed of thermoplastic rubber. In another embodiment, the forehead hammock 60 and the chin hammock 62 may be formed of nitrile rubber. In still another embodiment, the forehead hammock 60 and the chin hammock 62 may be formed of expanded polypropylene. In yet another embodiment, the forehead hammock 60 and the chin hammock 62 may be formed of thermoset rubber. In some embodiments, the forehead hammock 60 and the chin hammock 62 are formed of the same material(s). In other embodiments (as briefly discussed above), the forehead hammock 60 and the chin hammock 62 are formed of different materials. For example, the forehead hammock 60 may be formed of nitrile rubber and the chin hammock 62 may be formed of thermoset rubber.

Figure 16:
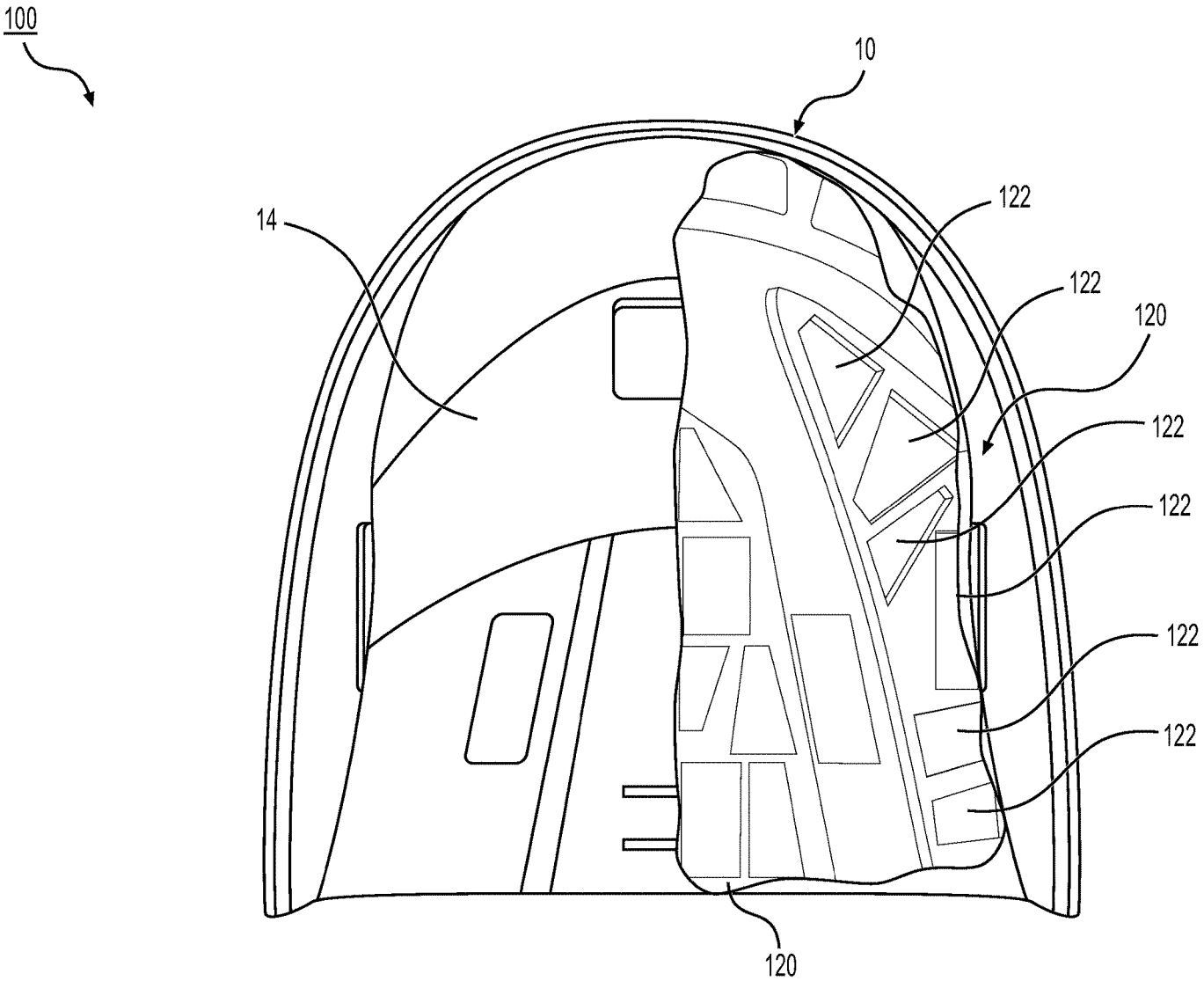
FIG. 16 is a top interior view of the protective headgear according to one embodiment of the present disclosure.
Figure 17:
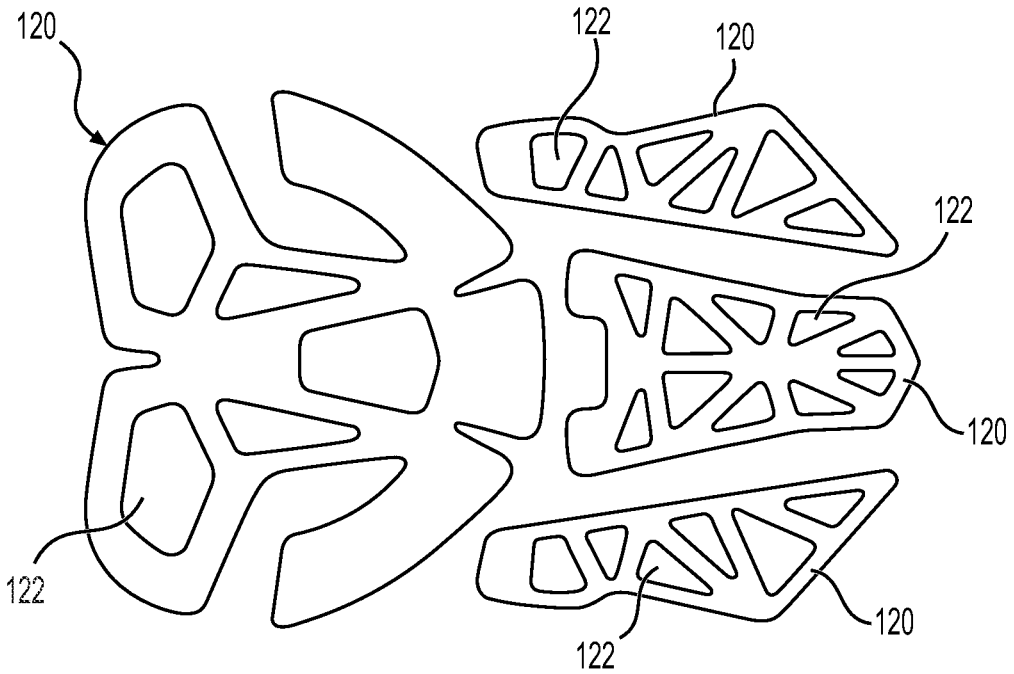
FIG. 17 is a top view of a plurality of padding inserts according to one embodiment of the present disclosure.
Figure 18:
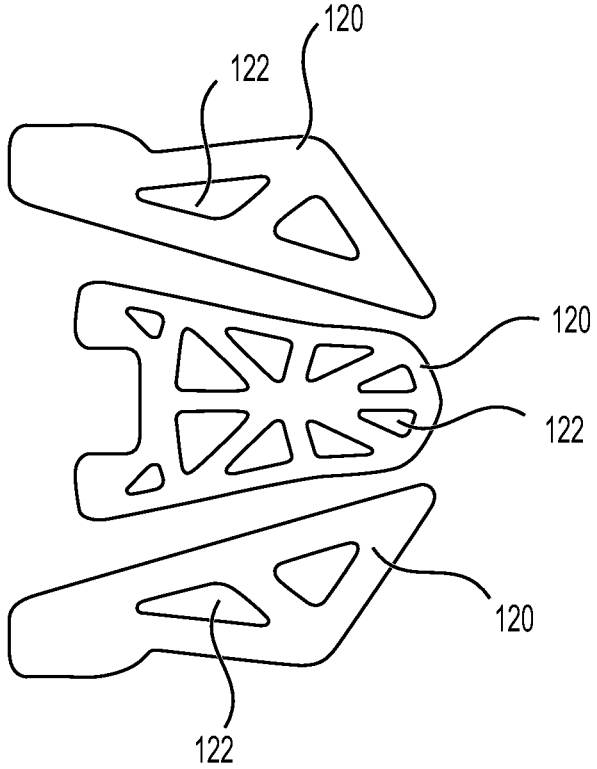
FIG. 18 is a top view of a plurality of padding inserts according to another embodiment of the present disclosure.

FIGS. 16-18 show padding inserts 120 according to an embodiment of the present disclosure. The padding inserts 120 of the present disclosure provide shock absorption properties and additional cushioning to help minimize and sustain blows to the protective headgear 100 during sporting play. The padding inserts 120 also facilitate ventilation throughout the front and back shells 10, 12 and allow air to circulate around the wearer's head for added comfort. As illustrated in FIG. 16, the padding inserts 120 are mounted within the front shell 10. More specifically, the padding inserts 120 are mounted within the crown portion 14 of the front shell 10 and disposed between the shell and the wearer's head. This allows for the padding inserts 120 to absorb impact energy when the protective headgear 100 is impacted. In further embodiments, the padding inserts 120 may also be mounted within the back shell 12.

The padding inserts 120 are configured within the front shell 10 to provide continuous or nearly continuous protection of the crown portion 14 and/or in the back shell 12 to provide continuous or nearly continuous protection of the back of the wearer's head. In the illustrated embodiment of FIG. 16, the padding inserts 120 are arranged adjacent to one another to provide continuous protection of the entire area of the crown portion 14. As shown in FIG. 16, three padding inserts 120 may be arranged adjacent to one another within the crown portion 14. However, as will be appreciated by those of ordinary skill in the art, any number of padding inserts 120 may be used in the crown portion 14. The number will depend on the size and dimensions of the padding insert(s) and the size of the protective headgear 100. For instance, a single monolithic padding insert 120 may be used if the padding insert 120 is sized and dimensioned to protect the entire surface area of the crown portion 14. In another embodiment, as shown in FIG. 17, for larger sized protective headgear 100, three padding inserts 120 (shown on the right) may be used to protect the entire surface area of the crown portion 14 and a larger padding insert 120 (shown on the left) may be used in the back shell 12 to protect the back of the wearer's head. In still another embodiment, as shown in FIG. 18, for smaller sized protective headgear 100, three smaller sized padding inserts 120 may be used to protect the area of the crown portion 14. Alternatively, more than four padding inserts 120, such as five, seven, or ten padding inserts, may be needed to protect the entire surface area of the crown portion 14. While FIG. 17 shows a single padding insert 120 that may be used in the back shell 12 of the protective headgear 100, other configurations of the padding inserts 120, such as the configuration shown in FIG. 16, can be used to provide continuous or nearly continuous protection of the entire area of the back shell 12.

Each padding insert 120 is composed of a plurality of cutouts 122. The cutouts 122 facilitate ventilation by creating holes or voids through which air can pass. The cutouts 122 may be cut, stamped, or otherwise formed within each padding insert 120. In some embodiments, the cutouts 122 are affected with die cutting. In further embodiments, each padding insert 120 may be formed using 3D printing techniques. In the illustrated embodiment, each padding insert 120 includes six cutouts 122. In this specific embodiment, the cutouts 122 are generally triangular shaped. In this regard, the complementary nature of each of the triangular shapes allows for a greater number of cutouts 122 to be formed in the padding insert 120, which, in turn, allows for increased ventilation and breathability. The shape of the cutouts 122 may vary. For example, the cutouts 122 may be circular, rectangular, square, or diamond shaped.

The dimensions of the cutouts 122 may also vary. In some embodiments, the cutouts 122 may have an overall size of about 0.5 inches to about 3 inches. In another embodiment, the cutouts 122 may have an overall size of about 0.75 inches to about 2.5 inches. In still another embodiment, the cutouts 122 may have an overall size of about 1 inch to about 2.3 inches. However, as will be apparent to those of ordinary skill in the art, the shape, size, and number of cutouts 122 in each padding insert 120 can vary depending on the size and shape of the overall padding insert 120 and how well the protective helmet 100 absorbs energy from certain impacts.

In some embodiments, the volume of all cutouts 122 on a padding insert 120 is about 10 percent or more of the total volume of the padding insert 120. In another embodiment, the volume of all cutouts 122 on a padding insert 120 is about 20 percent or more of the total volume of the padding insert 120. In still another embodiment, the volume of all cutouts 122 on a padding insert 120 is about 30 percent or more of the total volume of the padding insert 120. In yet another embodiment, the volume of all cutouts 122 on a padding insert 120 is about 40 percent or more of the total volume of the padding insert 120. In still further embodiments, the volume of all cutouts 122 on a padding insert 120 may be about 50 percent of the total volume of the padding insert 120.

In further embodiments, the cutouts 122 reduce the volume of each padding insert 120 by about 40 percent or less when compared to a solid padding insert having no cutouts. In other embodiments, the cutouts 122 reduce the volume of each padding insert 120 by about 30 percent or less when compared to a solid padding insert having no cutouts. In still other embodiments, the cutouts 122 reduce the volume of each padding insert 120 by about 20 percent or less when compared to a solid padding insert having no cutouts. For example, the cutouts 122 reduce the volume of each padding insert 120 by about 20 percent to about 30 percent when compared to a solid padding insert having no cutouts.

The padding inserts 120 of the present disclosure may be formed from any lightweight material having energy absorbing properties. Suitable materials for forming the padding inserts 120 include, but are not limited to, polymeric foam, such as vinyl nitrile, high density polyethylene (HDPE), expanded polypropylene (EPP), expanded polyethylene (EPE), expanded polystyrene (EPS), or polyurethane foam; expanded polymeric microspheres; and any combination of the foregoing. For example, in one embodiment, the padding inserts 120 may be made from vinyl nitrile. In another embodiment, the padding inserts 120 may be formed of ethylene vinyl acetate (EVA). In further embodiments, the padding inserts 120 may be formed of an elastomeric material. Suitable elastomeric materials include, but are not limited to, rubber, such as styrene-butadiene rubber or any other suitable rubber; a polyurethane elastomer, such as thermoplastic polyurethane (TPU); and any other thermoplastic elastomer. In still further embodiments, the padding inserts 120 may include a fluid, such as a liquid or a gas, which may be contained within a container (for example, a flexible bag, pouch, or other envelope) or implemented as a gel (for example, a polyurethane gel). Any other material with suitable impact energy absorption may be used in other embodiments.

The padding inserts 120 formed in accordance with the present disclosure should have a thickness that is sufficient to absorb impact energy when the protective headgear 100 is impacted, but also thin enough to not add extra weight to the crown portion 14. In some embodiments, the padding inserts 120 have a thickness of about 2 mm to about 20 mm. In another embodiment, the padding inserts 120 may have a thickness of about 4 mm to about 16 mm. In still another embodiment, the padding inserts 120 may have a thickness of about 8 mm to about 16 mm. In yet further embodiments, the padding inserts 120 may have a thickness of about 14 mm to about 16 mm.

The padding inserts 120 may be mounted within the front shell 10 and the back shell 12 in various ways. For example, in some embodiments, the padding inserts 120 may be mounted to an inner portion of the front or back shell 10, 12 by one or more fasteners, such as mechanical fasteners (for example, tacks, staples, rivets, screws, or stitches), hook and loop fasteners, an adhesive, or any other suitable fastener. In one embodiment, the padding inserts 120 are secured using hook and loop fasteners to allow for easy removal for cleaning.

FIG. 19 shows a faceguard 200 according to one embodiment of the present disclosure. The faceguard 200 protects the face of the wearer. As shown in FIG. 19, the faceguard 200 is comprised of wire members arranged as a grid that may be removably attached to the front shell 10 with fasteners. As will be described in detail below, the faceguard 200 of the present disclosure provides for enhanced protection against unintended impacts by extending the wire members (also known as the cage) past the wearer's ears. The shape of the faceguard 200 also enhances the structural stability of the protective headgear 100 while improving the overall weight distribution and balance for a secure and comfortable fit for the wearer.

The faceguard 200 is a grid of wire members including horizontal wire members and vertical wire members connected together by, for example, welding. The wire members may be composed of steel, titanium, magnesium, aluminum, or combinations thereof. The faceguard 200 includes five horizontal wire members, specifically, top upper member 202, top lower member 204, middle lower member 206, bottom upper member 208, and bottom lower member 210. The faceguard 200 also includes seven vertical wire members, specifically, first side vertical member 214, second side vertical member 216, front vertical members 218*a*, 218*b*, 218*c*, and slanted vertical members 212.

As illustrated in FIG. 19, the top upper member 202 extends from a point rearward of the ear hole 52, across the top front edge 24, to a point rearward of the opposite side ear hole 52. The middle lower member 206 extends around the ear hole 52 to meet the top upper member 202 at the point rearward of the ear hole 52 and extends across the face opening 34 to the point rearward of the opposite side ear hole 52 to join the other end of the top upper member 202. Slanted vertical members 212 extend in front of each ear hole 52 and connect the top upper member 202 to the middle lower member 206. In this manner, the faceguard 200 may provide coverage for the area surrounding the ear holes, thereby protecting that area from blows sustained during sports play. By extending the faceguard 200 around the ear holes 52, the protective headgear 100 has greater rigidity and can withstand and absorb impact much more efficiently than protective headgear having a faceguard that terminates before the ear holes. Indeed, the protective headgear 100 having the faceguard 200 extending around the ear holes 52 has been shown to reduce the impact severity, namely the Severity Index (SI) as developed by the National Operating Committee on Standards for Athletic Equipment (NOCSAE) (as compared to a protective helmet with a comparable faceguard, but lacking extension around the ears as in the faceguard of the present disclosure). In some embodiments, the protective headgear 100 of the present disclosure has a SI of at least about 30 percent lower than the SI of a protective helmet without a faceguard of the present disclosure, i.e., a faceguard that extends around the ear holes. In further embodiments, the protective headgear 100 of the present disclosure has a SI of at least about 40 percent lower than the SI of a protective helmet without a faceguard of the present disclosure, i.e., a faceguard that extends around the ear holes. In still further embodiments, the protective headgear 100 of the present disclosure has a SI of about 50 percent lower than the SI of a protective helmet without the faceguard of the present disclosure.

The top lower member 204 extends from the slanted vertical member 212, across the face opening 34, to the opposite slanted vertical member 212. The bottom lower member 208 extends along the jaw portion 22 from the first side vertical member 214 to the second side vertical member 216. The bottom member 210 extends along the bottom edge 30, connecting each of the front vertical members 218*a*, 218*b*, 218*c*.

Each of the first and second side vertical members 214, 216 extend from the top front edge 24 to the bottom lower member 208. The first and second side vertical members 214, 216 provide coverage for the area surrounding the side of the wearer's face, such as the cheeks. The front vertical members 218*a*, 218*b*, 218*c* extend from the top lower member 204 to the bottom member 210. The front vertical members 218*a*, 218*b*, 218*c* provide coverage for the front of the wearer's face, such as the nose and mouth.

The faceguard 200 may be removably attached to the front shell 10 by conventional fasteners and connectors inserted into the front shell 10 through holes formed therein. In one embodiment, as illustrated in FIG. 19, the faceguard 200 may include upper fasteners 220 for insertion into corresponding holes located on each side of the forehead portion 16. The upper fasteners 220 may be attached to the top upper member 202. In this embodiment, when the forehead hammock 60 is attached to the protective headgear 100, the upper fasteners 220 may be inserted through the front shell 10 and into the attachment holes 116 on the forehead hammock 60 to secure the faceguard 200 and the forehead hammock 60 to the front shell 10. Advantageously, the positioning of the upper fasteners 220 and the corresponding attachment holes 116 on the forehead hammock 60 allows for the fasteners to be placed on the sides of the forehead portion 16, rather than near the center of the forehead portion 16. This prevents a direct load on the wearer's forehead upon impact during sports play and provides better shock absorption.

The faceguard 200 may also include lower fasteners 224 for insertion into corresponding holes located on each side of the jaw portion 22. The lower fasteners 224 may be attached to the bottom lower member 208. In this embodiment, when the chin hammock 62 is attached to the protective headgear 100, the lower fasteners 224 may be received in the attachment holes 88 of the flaps 86*a*, 86*b* and inserted through the front shell 10 and attachment holes 90 on the chin hammock 62 to secure the faceguard 200 to the front shell 10. In further embodiments, the faceguard 200 may include side fasteners 222 attached to each of the slanted vertical members 212 for insertion into corresponding holes located on each of the side portions 18*a*, 18*b*.

The fasteners for attaching the faceguard 200 to the front shell 10, such as the upper, lower, and side fasteners 220, 224, 222, may be any type of mechanical fastener. For example, the fasteners may be a screw, a tab, a bolt, a rivet, a nail, a nut, a key, an anchor, a stud, a ring, a pin, or any other fastener commonly used to secure structural members. It should be noted that although fasteners 220, 222, 224 are inserted from the outside of the front shell 10, its disposition could be reversed, although it is preferred to be inserted from outside the shell, for ease of removal should a player be injured, and it becomes necessary to remove the faceguard 200.

As further shown in FIG. 19, straps 226, such as elastic straps, can be threaded through the slots 54 on each of the cheek portions 20 and adjusted. By adjusting the length of each of the straps 226, the back shell 12 can be comfortably sized to accommodate different head sizes of catchers/users of the protective headgear 100. A user can place his head in the protective headgear 100 by simply pulling the back shell 12 backward and away from the front shell 10 causing the straps 226 to stretch temporarily during the articulation/pivoting of the back shell 12. The opening defined between the front shells 10 and the back shell 12 progressively enlarges until the wearer's head can be positioned comfortably therein at which point the elasticity of the straps 226 returns the back shell 12 comfortably to the desired adjusted position. The elasticity of the straps 226 assures that the overall size of the protective headgear 100 is proper and affords optimum comfort and protection.

The protective headgear described and claimed herein is not to be limited in scope by the specific embodiments herein disclosed, since these embodiments are intended as illustrations of several aspects of the disclosure. Any equivalent embodiments are intended to be within the scope of this disclosure. Indeed, various modifications of the protective headgear in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A protective headgear, comprising:

a front shell operatively attached to a back shell, wherein the front shell and the back shell form an opening therebetween adapted to receive and protect a head of a wearer, the front shell comprising a crown portion, a forehead portion, opposite side face portions, and a jaw portion, a shock absorbing member attached to the front shell, the shock absorbing member comprising a first shock absorbing member attached to the forehead portion, wherein the first shock absorbing member comprises an outer portion curved to conform to an inner curvature of the forehead portion, a flange extending outwardly from the outer portion, a groove formed between the flange and the outer portion, and an inner portion attached to the outer portion, the inner portion having a curvature to conform to the curvature of the outer portion, wherein the inner portion is separated from the outer portion by a plurality of connectors forming segmented openings therebetween, and wherein the forehead portion is configured to fit within the groove.

2. The protective headgear of claim 1, further comprising a second shock absorbing member attached to the jaw portion, wherein the second shock absorbing member comprises an outer surface having a substantially convex surface to conform to an inner curvature of the jaw portion, a lip extending outwardly from a lower edge of the outer surface, and a groove formed between the lip and the outer surface, wherein the jaw portion is configured to fit within the groove.

3. The protective headgear of claim 2, wherein the second shock absorbing member comprises two outwardly protruding flaps attached to an upper edge of the outer surface, the two outwardly protruding flaps configured to fold over the jaw portion when positioned in the groove.

4. The protective headgear of claim 2, wherein each of the first and second shock absorbing members are formed of a material having a hardness of about 50 Shore A to about 80 Shore A.

5. The protective headgear of claim 4, wherein the first shock absorbing member is formed of a material having a first hardness, the second shock absorbing member is formed of a material having a second hardness, and the first hardness is different from the second hardness.

6. The protective headgear of claim 2, wherein each of the first and second shock absorbing members are formed of a material selected from the group consisting of ethylene vinyl acetate (EVA), vinyl nitrile, thermoplastic rubber (TPR), polypropylene (PP), expanded polypropylene (EPP), thermoset rubber (TSR), nitrile rubber, acrylonitrile butadiene styrene (ABS), PC/ABS compounds, styrene or high impact styrene (HIPS), and combinations thereof.

7. A protective headgear, comprising:

a front shell operatively attached to a back shell, wherein the front shell and the back shell form an opening therebetween adapted to receive and protect a head of a wearer, the front shell comprising a crown portion, a forehead portion, opposite side face portions, and a jaw portion, a shock absorbing member attached to the jaw portion, wherein the shock absorbing member comprises an outer surface having a substantially convex surface to conform to an inner curvature of the jaw portion, a lip extending outwardly from a lower edge of the outer surface, and a groove formed between the lip and the outer surface, wherein the jaw portion is configured to fit within the groove, and a padding insert disposed within at least one of the crown portion or the back shell, wherein the padding insert comprises a plurality of cutouts and the padding insert is formed of a polymeric foam selected from the group consisting of ethylene vinyl acetate (EVA), vinyl nitrile, high density polyethylene (HDPE), expanded polypropylene (EPP), expanded polyethylene (EPE), expanded polystyrene (EPS), polyurethane foam, and combinations thereof.

8. The protective headgear of claim 7, further comprising a shock absorbing member attached to the forehead portion, wherein the shock absorbing member attached to the forehead portion comprises an outer portion curved to conform to an inner curvature of the forehead portion, a flange extending outwardly from the outer portion, and a groove formed between the flange and the outer portion, wherein the forehead portion is configured to fit within the groove.

9. The protective headgear of claim 7, wherein the padding insert is dimensioned to provide continuous protection of the crown portion, the back shell, or both.

10. The protective headgear of claim 7, wherein the cutouts are substantially triangular shaped.

11. The protective headgear of claim 7, wherein the back shell comprises a lip positioned along a lowermost edge, the lip having an outwardly concave shape.

12. A protective headgear, comprising:

a front shell operatively attached to a back shell, wherein the front shell and the back shell form an opening therebetween adapted to receive and protect a head of a wearer, the front shell comprising a face opening, a crown portion, a forehead portion, opposite side face portions having ear holes formed therein, and a jaw portion, a shock absorbing member attached to the front shell, the shock absorbing member comprising a first shock absorbing member attached to the forehead portion and a second shock absorbing member attached to the jaw portion, wherein each of the first and second shock absorbing members are formed of a material having a hardness of about 50 Shore A to about 80 Shore A and the first shock absorbing member comprises an outer portion curved to conform to an inner curvature of the forehead portion, a flange extending outwardly from the outer portion, and a groove formed between the flange and the outer portion, wherein the forehead portion is configured to fit within the groove, and a faceguard removably attached to the front shell, the faceguard comprising a plurality of horizontal and vertical wire members joined together, wherein at least two of the horizontal wire members are configured to extend past the face opening to meet at a location rearward of the ear holes, thereby protecting an area surrounding the ear holes.

13. The protective headgear of claim 12, wherein the second shock absorbing member comprises an outer surface having a substantially convex surface to conform to an inner curvature of the jaw portion, a lip extending outwardly from a lower edge of the outer surface, and a groove formed between the lip and the outer surface, wherein the jaw portion is configured to fit within the groove.

14. The protective headgear of claim 12, further comprising a padding insert disposed within at least one of the crown portion or the back shell, the padding insert comprising a plurality of cutouts and formed of a polymeric foam.

15. The protective headgear of claim 14, wherein the padding insert is formed of vinyl nitrile.

16. The protective headgear of claim 12, wherein the back shell comprises a lip positioned along a lowermost edge, the lip having an outwardly concave shape.

* * * * *